US011442395B2

(12) United States Patent
Hatano

(10) Patent No.: US 11,442,395 B2
(45) Date of Patent: Sep. 13, 2022

(54) TRANSFER BELT UNIT INCLUDING BELT FRAME, HOLDER MOVABLE RELATIVE THERETO, ELECTRICAL CONTACT SURFACE HELD THEREBY, AND STORAGE ELEMENT ELECTRICALLY CONNECTED THERETO

(71) Applicant: BROTHER KOGYO KABUSHIKI KAISHA, Nagoya (JP)

(72) Inventor: Shuhei Hatano, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/379,324

(22) Filed: Jul. 19, 2021

(65) Prior Publication Data

US 2021/0349417 A1 Nov. 11, 2021

Related U.S. Application Data

(63) Continuation of application No. 16/892,689, filed on Jun. 4, 2020, now Pat. No. 11,067,936.

(30) Foreign Application Priority Data

Jun. 6, 2019 (JP) ..... JP2019-106190

(51) Int. Cl.

| | |
|---|---|
| ***G03G 21/16*** | (2006.01) |
| ***G03G 15/08*** | (2006.01) |
| ***G03G 15/00*** | (2006.01) |
| ***G03G 15/16*** | (2006.01) |
| ***G03G 21/18*** | (2006.01) |

(52) U.S. Cl.

CPC ..... *G03G 15/80* (2013.01); *G03G 15/0863* (2013.01); *G03G 15/1615* (2013.01); *G03G 21/168* (2013.01); *G03G 21/1878* (2013.01)

(58) Field of Classification Search

CPC ... G03G 2221/1684; G03G 2215/0132; G03G 21/1652; G03G 15/1615; G03G 21/168; G03G 15/0194

See application file for complete search history.

(56) References Cited

U.S. PATENT DOCUMENTS

| | | | |
|---|---|---|---|
| 6,324,355 | B1 | 11/2001 | Matsui et al. |
| 2007/0177894 | A1 | 8/2007 | Nakano et al. |
| 2008/0240750 | A1 | 10/2008 | Hanamoto et al. |

(Continued)

FOREIGN PATENT DOCUMENTS

| | | | |
|---|---|---|---|
| JP | 11-344875 | A | 12/1999 |
| JP | 2007-10839 | A | 1/2007 |

(Continued)

*Primary Examiner* — Jessica L Eley

(74) *Attorney, Agent, or Firm* — Merchant & Gould P.C.

(57) ABSTRACT

A transfer belt unit includes a belt frame, a transfer belt, a storage element, an electrical contact surface, a pressing member, and a holder. The storage element stores therein information on the transfer belt. The electrical contact surface is electrically connected to the storage element. The pressing member presses the electrical contact surface in a pressing direction. The holder is positioned at the belt frame and holds the electrical contact surface. The holder is movable relative to the belt frame in a direction crossing the pressing direction.

24 Claims, 15 Drawing Sheets

(56) References Cited

U.S. PATENT DOCUMENTS

| | | | | |
|---|---|---|---|---|
| 2009/0067872 | A1* | 3/2009 | Kim | G03G 15/0863 399/83 |
| 2016/0291535 | A1* | 10/2016 | Hashimoto | G03G 21/1652 |
| 2017/0269515 | A1 | 9/2017 | Nakamura et al. | |
| 2018/0149998 | A1 | 5/2018 | Furukawa | |

FOREIGN PATENT DOCUMENTS

| | | | | |
|---|---|---|---|---|
| JP | 2012-238027 | A | | 12/2012 |
| JP | 2017049356 | A | * | 3/2017 |
| JP | 2018-5065 | A | | 1/2018 |

* cited by examiner

TRANSFER BELT UNIT INCLUDING BELT FRAME, HOLDER MOVABLE RELATIVE THERETO, ELECTRICAL CONTACT SURFACE HELD THEREBY, AND STORAGE ELEMENT ELECTRICALLY CONNECTED THERETO

CROSS REFERENCE TO RELATED APPLICATION

This application is a continuation of U.S. patent application Ser. No. 16/892,689, filed Jun. 4, 2020, which claims priority from Japanese Patent Application No. 2019-106190 filed Jun. 6, 2019. The entire content of the priority applications is incorporated herein by reference.

TECHNICAL FIELD

The present disclosure relates to a transfer belt unit and an image forming apparatus including the transfer belt.

BACKGROUND

There has been conventionally known an image forming apparatus including a transfer belt unit attachable to and detachable from the image forming apparatus. The transfer belt unit includes a belt memory storing therein information on the transfer belt unit.

SUMMARY

When the transfer belt unit is attached to the image forming apparatus, an electrical contact surface of the belt memory may be occasionally displaced from an electrical contact of the body of the image forming apparatus. The displacement may lead to read-error that the information stored in the belt memory is not properly read. Hence, stable positioning of the electrical contact surface with respect to the electrical contact is required.

In view of foregoing, it is an object of the disclosure to provide a transfer belt unit and an image forming apparatus which are capable of suppressing error in reading from the belt memory.

In order to attain the above object and other objects, according to one aspect, the present disclosure provides a transfer belt unit includes a belt frame, a transfer belt, a storage element, an electrical contact surface, a pressing member, and a holder. The storage element stores therein information on the transfer belt. The electrical contact surface is electrically connected to the storage element. The pressing member presses the electrical contact surface in a pressing direction. The holder is positioned at the belt frame and holds the electrical contact surface. The holder is movable relative to the belt frame in a direction crossing the pressing direction.

According to another aspect, the present disclosure provides an image forming apparatus including a main body, a transfer belt unit, and an electrical contact. The transfer belt unit is attachable to and detachable from the main body. The transfer belt unit includes a belt frame, a transfer belt, a storage element, an electrical contact surface, a pressing member, a holder, a drive roller, and a follower roller. The storage element stores therein information on the transfer belt. The electrical contact surface is electrically connected to the storage element. The pressing member presses the electrical contact surface in a pressing direction. The holder is positioned at the belt frame and holds the electrical contact surface. The holder is movable relative to the belt frame in a direction crossing the pressing direction. The drive roller is configured to drive the transfer belt. The drive roller is rotatable about a first axis extending in a first direction and is in contact with an inner peripheral surface of the transfer belt. The follower roller is configured to rotate about a second axis in accordance with the transfer belt being driven. The second axis extends in the first direction. The follower roller is in contact with the inner peripheral surface of the transfer belt, and is positioned spaced away from the drive roller in a second direction crossing the first direction. The holder is movable relative to the belt frame in the first direction. The holder includes a memory holding portion and a protrusion. The memory holding portion holds the electrical contact surface. The protrusion protrudes from a body portion of the holder in the first direction. The protrusion is configured to enter a groove of the main body to fix a position of the holder with respect to the main body. The electrical contact is configured to be in electrical contact with the electrical contact surface of the transfer belt unit in a state where the transfer belt unit is attached to the main body.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
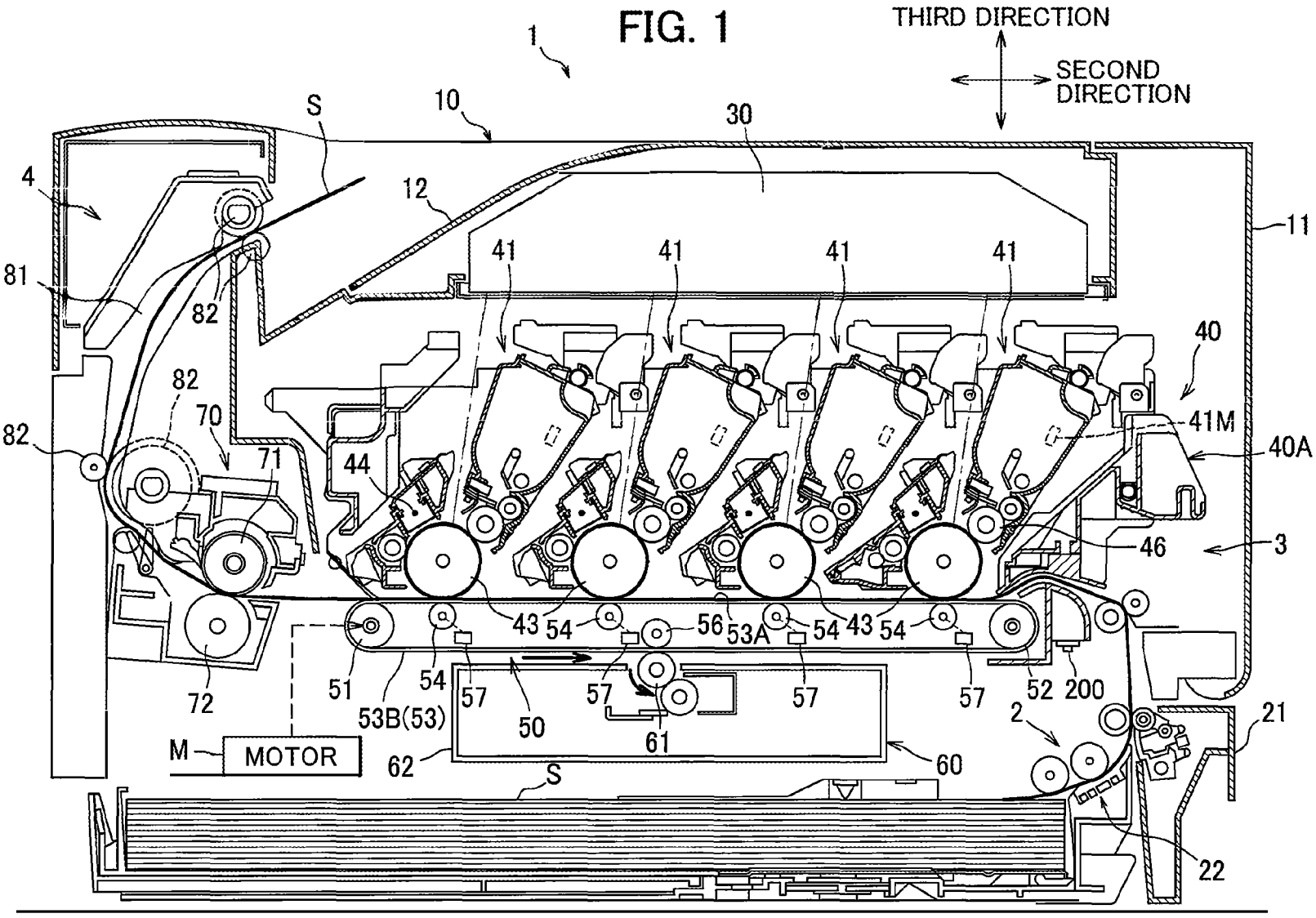
FIG. 1 is a view illustrating an overview configuration of an image forming apparatus according to an embodiment.

An image forming apparatus 1 according to one embodiment will be described while referring to the accompanying drawings. As illustrated in FIG. 1, the image forming apparatus 1 is, as an example, a color laser printer. The printer 1 includes a main body 10, a sheet supply portion 2 for supplying sheets S, an image forming portion 3 for forming images on the sheets S supplied by the sheet supply portion 2, and a discharge portion 4 for discharging the sheets S having the images formed thereon.

The sheet supply portion 2 is positioned at a lower internal portion of the main body 10. The sheet supply portion 2 includes a sheet tray 21 for accommodating therein the sheets S, and a sheet supplying mechanism 22 for supplying the sheets S from the sheet tray 21 to the image forming portion 3. The sheets S in the sheet tray 21 are separated and supplied one at a time to the image forming portion 3 by the sheet supplying mechanism 22.

The image forming portion 3 includes an exposure unit 30, an image forming unit 40, a transfer belt unit 50, a belt cleaner 60, and a fixing unit 70.

The exposure unit 30 is positioned in an upper internal portion of the main body 10. Although not shown in the drawings, the exposure unit 30 includes laser light-emitting portions, a polygon mirror, lenses, and reflecting mirrors.

The image forming unit 40 includes a drum cartridge 40A attachable to and detachable from the main body 10, and four developing cartridges 41 attachable to and detachable from the drum cartridge 40A. In a state where the drum cartridge 40A is attached to the main body 10, the drum cartridge 40A is positioned between the sheet supply portion 2 and the exposure unit 30. The drum cartridge 40A is movable between an attached position (the position shown in FIG. 1) inside the main body 10 and a detached position at which the drum cartridge 40A has been pulled out of the main body 10.

The drum cartridge 40A includes four photosensitive drums 43 and four chargers 44. Each developing cartridge 41 includes a developing roller 46, and a supply roller, a layer-thickness regulating blade and a toner-accommodating portion for which reference numerals are omitted.

The transfer belt unit 50 is attachable to and detachable from the main body 10. In a state where the transfer belt unit 50 is attached to the main body 10, the transfer belt unit 50 is positioned between the sheet supply portion 2 and the image forming unit 40. The transfer belt unit 50 includes a drive roller 51, a follower roller 52, a transfer belt 53, four transfer rollers 54, four belt electrodes 57, and a backup roller 56.

The drive roller 51 is a roller configured to drive the transfer belt 53. The drive roller 51 is in contact with an inner peripheral surface of the transfer belt 53. The axial direction of the drive roller 51 will be defined as a first direction. The drive roller 51 is rotatable about a first axis X1 (FIG. 2) extending in the first direction. Driving force generated by a motor M of the image forming apparatus 1 is transmitted to the drive roller 51, so that the transfer belt 53 circularly moves in a direction indicated by an arrow shown in FIG. 1 (i.e., in a counterclockwise direction in FIG. 1).

The follower roller 52 is a roller configured to rotate in accordance with the transfer belt 53 being driven. The follower roller 52 is in contact with the inner peripheral surface of the transfer belt 53. The follower roller 52 is rotatable about a second axis X2 (FIG. 2) extending in the first direction.

Here, a direction in which the drive roller 51 and the follower roller 52 are arrayed will be defined as a second direction. The second direction crosses the first direction. Preferably, the second direction is perpendicular to the first direction. The drive roller 51 and the follower roller 52 are positioned away from each other in the second direction. In the present embodiment, the second direction is perpendicular to the first direction and also is a direction in which the first axis X1 and the second axis X2 are arrayed.

The transfer belt 53 is in contact with the photosensitive drums 43 in the state where the transfer belt unit 50 is attached to the main body 10. The transfer belt 53 is configured to transfer toner images formed on the photosensitive drums 43 onto the sheet S conveyed to portions between the photosensitive drums 43 and the transfer belt 53, and to convey, to the fixing unit 70, the sheet S conveyed to the portions between the photosensitive drums 43 and the transfer belt 53. The transfer belt 53 is an endless belt.

The transfer rollers 54 are in contact with the inner peripheral surface of the transfer belt 53. Each of the transfer rollers 54 is a roller configured to nip, in cooperation with a corresponding one of the photosensitive drums 43, the transfer belt 53 therebetween. Each of the transfer rollers 54 has one end portion and another end portion in the first direction, the one end portion being at one side in the first direction, the other end portion being at another side in the first direction.

Each of the belt electrodes 57 is positioned at the other end portion of a corresponding one of the transfer rollers 54 in the first direction. The belt electrode 57 is electrically connected to the corresponding transfer roller 54. The belt electrode 57 is configured to apply transfer bias to the corresponding transfer roller 54 to transfer the toner image formed on the corresponding photosensitive drum 43 onto the sheet S in a state where the sheet S has been conveyed to the portion between the corresponding photosensitive drum 43 and the transfer belt 53.

The belt cleaner 60 is positioned below the transfer belt unit 50. The belt cleaner 60 includes a cleaning roller 61, and a collection box 62. The cleaning roller 61 is in contact with a bottom surface 53B of the transfer belt 53. The cleaning roller 61 is configured to collect toner on the transfer belt 53 and to put the collected tonner in the collection box 62. The cleaning roller 61 and the backup roller 56 nip the conveying belt 53 therebetween.

The fixing unit 70 is positioned downstream of both the image forming unit 40 and the transfer belt unit 50 in a conveying direction of the sheet S. The fixing unit 70 includes a heat roller 71 and a pressure roller 72. The pressure roller 72 is positioned to face the heat roller 71 and presses the heat roller 71.

In the image forming portion 3, each of the chargers 44 applies a uniform charge to a surface of the corresponding photosensitive drum 43, after which the exposure unit 30 irradiates laser beams (indicated by one dotted chain lines in FIG. 1) to the surfaces of the respective photosensitive drums 43. As a result, electrostatic latent images are formed on the respective photosensitive drums 43. Each of the supply rollers supplies toner from the corresponding toner-accommodating portion to the corresponding developing roller 46. After that, the toner is carried on the corresponding developing roller 46.

The toner carried on each of the developing rollers 46 is then supplied to the electrostatic latent image formed on the corresponding photosensitive drum 43 to produce a toner image on that photosensitive drum 43. Thereafter, the sheet S supplied onto the transfer belt 53 is conveyed to the portions between the photosensitive drums 43 and the transfer rollers 54, whereupon the toner images formed on the photosensitive drums 43 are sequentially transferred to and superposed on the sheet S. After that, the sheet S is conveyed to a portion between the heat roller 71 and the pressure roller 72, whereby the transferred toner images are thermally fixed to the sheet S.

The discharge portion 4 includes a discharge path 81 and a plurality of conveying rollers 82 for conveying the sheets S. The discharge path 81 extends upward from the exit of the fixing unit 70 and subsequently curves forward. The sheet S having the toner images thermally fixed thereto is conveyed along the discharge path 81 by the conveying rollers 82. After that, the sheet S is discharged onto a discharge tray 12 provided at an upper part of the main body 10.

Here, a direction in which the discharge tray 12, the image forming portion 3, and the sheet tray 21 are arrayed will be defined as a third direction. The third direction crosses both the first direction and the second direction. Preferably, the third direction is perpendicular to both the first direction and the second direction. In the depicted embodiment, the third direction is the up-down direction.

The main body 10 is provided with a front cover 11 that can be opened and closed. The front cover 11 serves as a front wall of the main body 10. In a state where the front cover 11 is open, the user can pull the drum cartridge 40A out of the main body 10 to the outside thereof. That is, the drum cartridge 40A is attachable to and detachable from the main body 10. In a state where the drum cartridge 40A is detached from the main body 10, the user can detach the transfer belt unit 50 from the main body 10 to the outside thereof.

Figure 2:
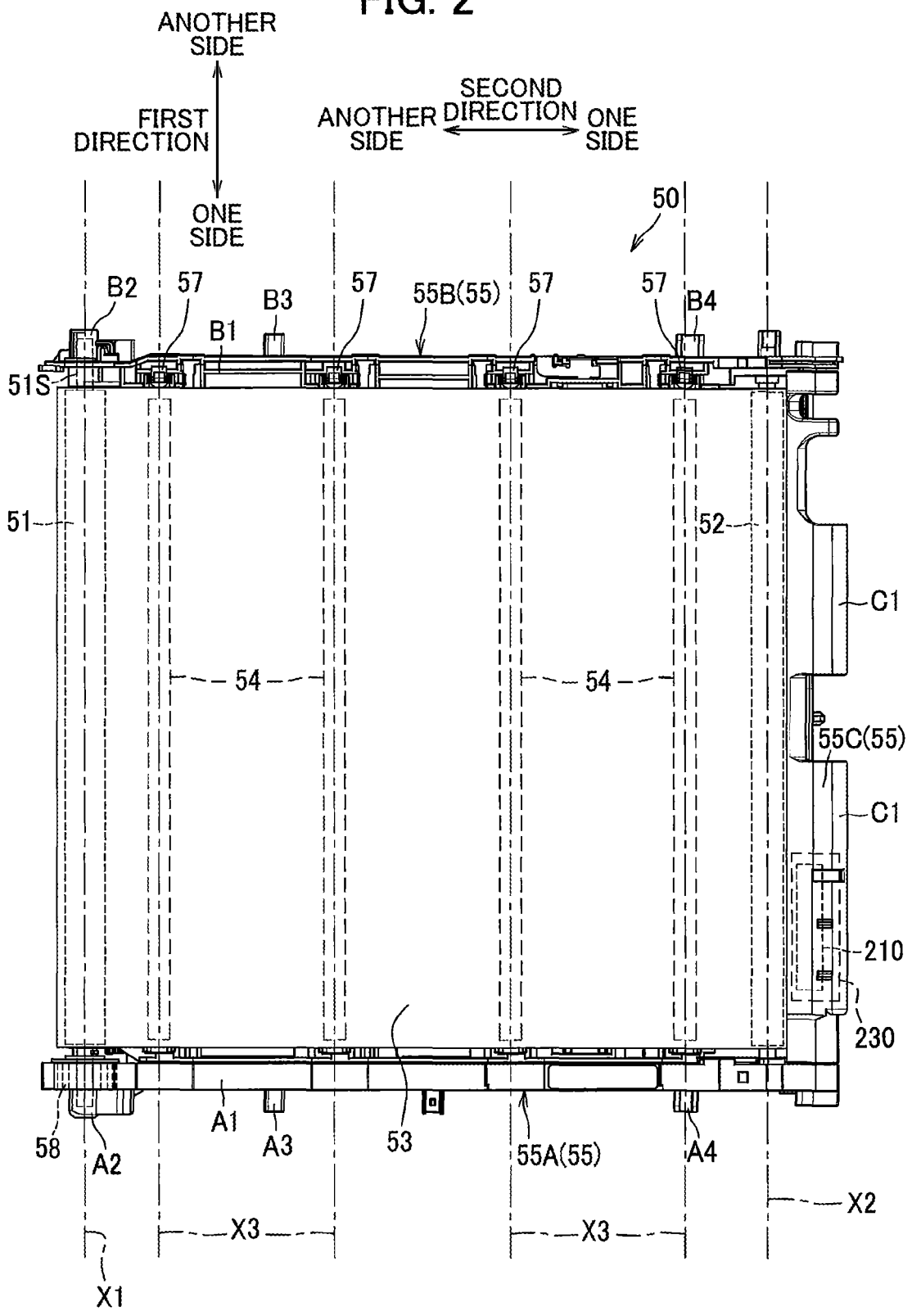
FIG. 2 is a plan view illustrating a transfer belt unit according to the embodiment.

Next, detailed structures of the transfer belt unit 50 and the periphery thereof will be described. As illustrated in FIG. 2, the transfer belt unit 50 further includes a belt frame 55, in addition to the drive roller 51 and the like described above. The belt frame 55 rotatably supports the drive roller 51 and the follower roller 52. Further, the belt frame 55 rotatably supports the transfer rollers 54. The belt frame 55 has one end portion and another end portion in the first direction, the one end portion being at the one side in the first direction, the other end portion being at the other side in the first direction.

The transfer roller 54 is rotatable about a third axis X3 extending in the first direction. In the present embodiment, the four transfer rollers 54 are arrayed in the second direction. The belt electrodes 57 are positioned at an end portion of the belt frame 55 in the first direction (i.e., at the other end portion of the belt frame 55 in the first direction in FIG. 2).

The belt frame 55 includes a first frame 55A, a second frame 55B, a third frame 55C, and a handle C1. The first frame 55A is positioned at one end portion of the transfer belt 53 in the first direction, the one end portion being at the one side in the first direction. The second frame 55B is positioned at another end portion of the transfer belt 53 in the first direction, the other end portion being at the other side in the first direction. Each of the first frame 55A and the second frame 55B has one end portion and another end portion in the second direction, the one end portion being at one side in the second direction, the other end portion being at another side in the second direction.

The third frame 55C is positioned at one end portion of the transfer belt 53 in the second direction, the one end portion being at the one side in the second direction. The third frame 55C connects the one end portion of the first frame 55A in the second direction and the one end portion of the second frame 55B in the second direction.

The handle C1 is positioned on the third frame 55C. The handle C1 is positioned at one end portion of the belt frame 55 in the second direction, the one end portion being at the one side in the second direction. The user can grip the handle C1 and perform the operations of attachment and detachment of the transfer belt unit 50.

The first frame 55A includes a body portion A1, a bearing A2, an engagement protrusion A3, and a counterpart support portion A4. The body portion A1 extends in the second direction. The bearing A2, the engagement protrusion A3, and the counterpart support portion A4 protrude from a side surface of the body portion A1 in a direction from the other side toward the one side in the first direction. That is, the bearing A2, the engagement protrusion A3, and the counterpart support portion A4 protrude from the body portion A1 in a direction away from the second frame 55B in the first direction.

The second frame 55B includes a body portion B1, a bearing B2, an engagement protrusion B3, and a counterpart support portion B4. The body portion B1 extends in the second direction. The bearing B2, the engagement protrusion B3, and the counterpart support portion B4 protrude from a side surface of the body portion B1 in a direction from the one side toward the other side in the first direction. That is, the bearing B2, the engagement protrusion B3, and the counterpart support portion B4 protrude from the body portion B1 in a direction away from the first frame 55A in the first direction.

Here, the drive roller 51 has a shaft 51S. The shaft 51S has one end portion and another end portion in the first direction, the one end portion being at the one side in the first direction, the other end portion being at the other side in the first direction.

The bearing A2 rotatably supports the one end portion of the shaft 51S in the first direction. The bearing B2 rotatably supports the other end portion of the shaft 51S in the first direction. The bearings A2 and B2 are members having a hollow cylindrical shape. The bearing A2 is positioned at the other end portion of the first frame 55A in the second direction. The bearing B2 is positioned at the other end portion of the second frame 55B in the second direction. The drive roller 51 has a drive gear 58. The drive gear 58 is configured to transmit driving force from the motor M of the image forming apparatus 1 to the drive roller 51. The drive gear 58 is positioned at the first frame 55A.

Figure 3A:
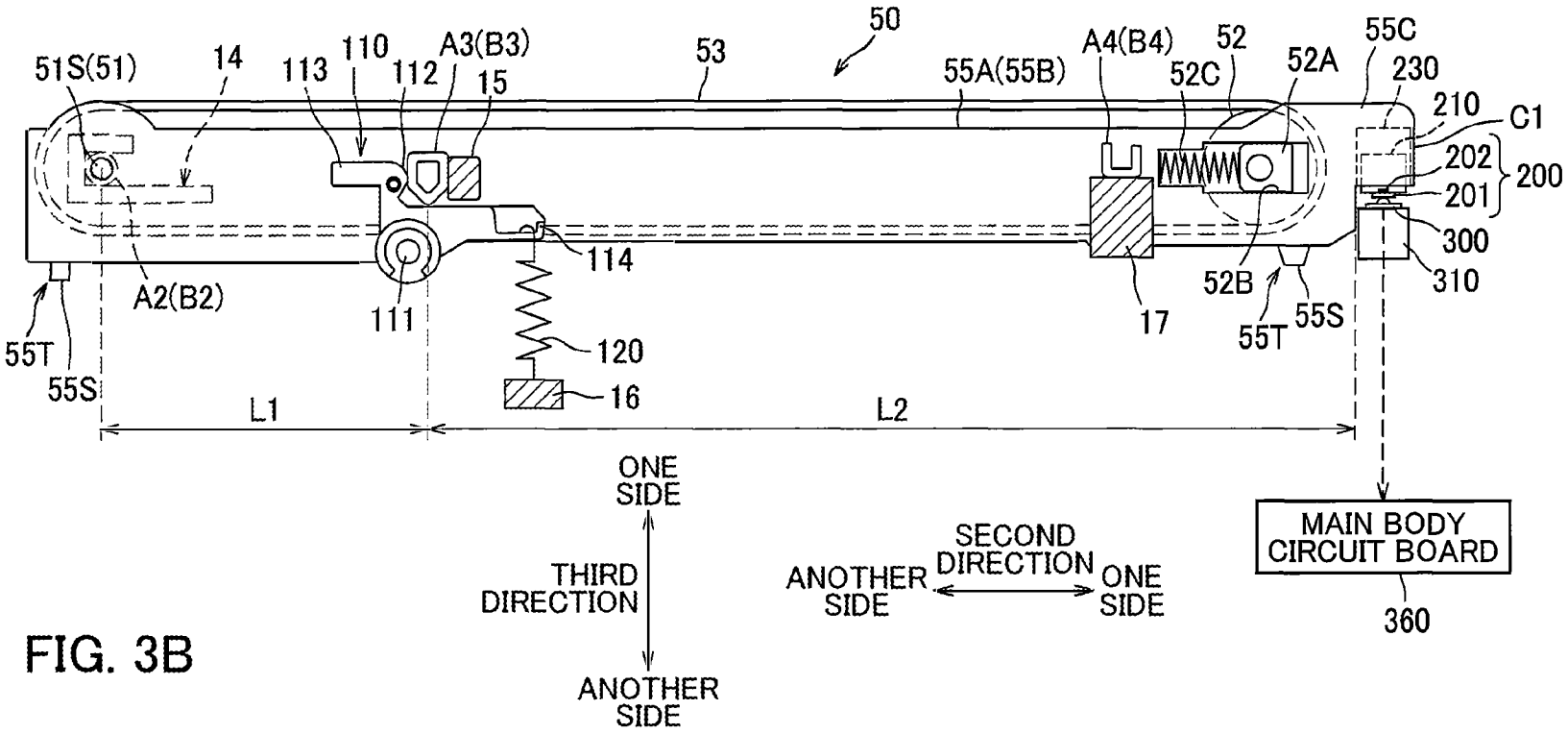
FIG. 3A is a side view illustrating, in a simplified manner, a relationship between a pressure lever and the transfer belt unit positioned at a contacting position.

Two restricting portions 14 are provided at the main body 10. As illustrated in FIG. 3A, each of the bearings A2 and B2 is supported by a corresponding one of the two restricting portions 14 in the state where the transfer belt unit 50 is attached to the main body 10. The restricting portions 14 are configured to regulate, via the bearings A2 and B2, a position of the drive roller 51 in the third direction crossing both the first direction and the second direction. In the present embodiment, the third direction is perpendicular to both the first direction and the second direction.

Figure 3B:
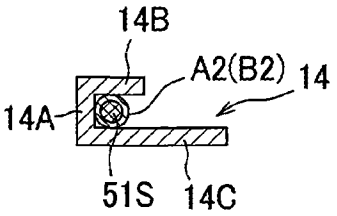
FIG. 3B is a cross-sectional view illustrating a relationship between a bearing and a restricting portion.

As illustrated in FIG. 3B, each of the restricting portions 14 includes a bottom portion 14A, an upper portion 14B, and a lower portion 14C. The bottom portion 14A extends in the third direction. The bottom portion 14A has one end portion and another end portion in the third direction, the one end portion being at one side in the third direction, the other end portion being at another side in the third direction.

The upper portion 14B extends, from the one end portion of the bottom portion 14A in the third direction, in a direction from the other side toward the one side in the second direction. The lower portion 14C extends, from the other end portion of the bottom portion 14A in the third direction, in the direction from the other side toward the one side in the second direction. Thus, the restricting portion 14 has U-shape having an opening which opens in the direction from the other side toward the one side in the second direction. A length of the lower portion 14C in the second direction is greater than a length of the upper portion 14B in the second direction.

A gap length between the upper portion 14B and the lower portion 14C is greater than an outer diameter of each of the bearings A2 and B2. Hence, each of the bearings A2 and B2 is inserted into the corresponding restricting portion 14 in the state where the transfer belt unit 50 is attached to the main body 10. Accordingly, movement of each of the bearings A2 and B2 in the third direction is restricted by the upper portion 14B and lower portion 14C of the corresponding restricting portion 14.

The bottom portion 14A of each of the restricting portions 14 is configured to regulate a position of the drive roller 51 in the second direction. Each of the bottom portions 14A is in contact with a corresponding one of the bearings A2 and B2 in the state where the transfer belt unit 50 is attached to the main body 10. Note that, in the state where the transfer belt unit 50 is attached to the main body 10, each of the bottom portions 14A may be positioned spaced away from the corresponding one of the bearing A2 and B2 in the second direction.

Further, the transfer belt unit 50 is pivotally movable about the axis X1 of the drive roller 51 in a process of attaching and detaching the transfer belt unit 50 to and from the main body 10. Specifically, the transfer belt unit 50 is pivotally movable about the axis X1 of the drive roller 51 between a contacting position illustrated in FIG. 3A and a separated position illustrated in FIG. 4.

Two pressure levers 110 are provided at the main body 10. As illustrated in FIG. 3A, each of the engagement protrusions A3 and B3 is a member configured to be pressed by a corresponding one of the two pressure levers 110. The engagement protrusions A3 and B3 have a tapered shape. A distance in the second direction between the engagement protrusion A3 and the drive roller 51 is a first distance L1. A distance in the second direction between the engagement protrusion B3 and the drive roller 51 is also the first distance L1. A distance in the second direction between the engagement protrusion A3 and the handle C1 is a second distance L2, which is greater than the first distance L1. A distance in the second direction between the engagement protrusion B3 and the handle C1 is also the second distance L2.

Specifically, a distance in the second direction from the axis X1 of the drive roller 51 to a contact point between the engagement protrusion A3 and the corresponding pressure lever 110 is the first distance L1. Also, a distance in the second direction from the axis X1 of the drive roller 51 to a contact point between the engagement protrusion B3 and the corresponding pressure lever 110 is the first distance L1. Here, the handle C1 has one end and another end in the second direction, the one end being at the one side in the second direction, the other end being at the other side in the second direction. A distance in the second direction from the contact point between the engagement protrusion A3 and the corresponding pressure lever 110 to the other end of the handle C1 in the second direction is the second distance L2. Also, a distance in the second direction from the contact point between the engagement protrusion B3 and the corresponding pressure lever 110 to the other end of the handle C1 in the second direction is the second distance L2.

Two positioning protrusions 15 are provided at the main body 10. Each of the two pressure levers 110 is a member configured to press the corresponding one of the engagement protrusions A3 and B3 in the second direction toward a corresponding one of the two positioning protrusions 15. Each of the pressure levers 110 is pivotally movable between an initial position illustrated in FIG. 4 and a pressing position illustrated in FIG. 3A. Incidentally, in the state where the transfer belt unit 50 is attached to the main body 10, the positioning protrusion 15, the restricting portion 14, and the pressure lever 110 are positioned at each side of the transfer belt unit 50 in the first direction.

Each of the two pressure levers 110 includes a pivot shaft 111, a first arm 112, a guide portion 113, and a second arm 114. The pivot shaft 111 is rotatably supported by the main body 10. The first arm 112 extends from the pivot shaft 111 in a direction from the other side toward the one side in the third direction. The first arm 12 is configured to nip, in cooperation with the corresponding positioning protrusion 15, the corresponding one of the engagement protrusions A3 and B3 therebetween. The first arm 112 has one end portion and another end portion in the third direction, the one end portion being at the one side in the third direction, the other end portion being at the other side in the third direction. The one end portion of the first arm 112 in the third direction is tapered.

The guide portion 113 protrudes, from the one end portion of the first arm 112 in the third direction, in a direction from the one side toward the other side in the second direction. The second arm 114 extends from the pivot shaft 111 in the direction from the other side toward the one side in the second direction.

The main body 10 is provided with two tension coil springs 120, two spring engagement portions 16, and two support portions 17. Each of the tension coil springs 120 has one end portion connected to a tip end portion of the second arm 114 of the corresponding pressure lever 110, and another end portion connected to the corresponding spring engagement portion 16. Hence, each of the pressure levers 110 is always urged from the pressing position toward the initial position by the corresponding tension coil spring 120.

Further, each of the pressure levers 110 urged by the corresponding tension coil spring 120 presses the corresponding one of the engagement protrusions A3 and B3 against the corresponding positioning protrusion 15 in the second direction. As a result, the transfer belt unit 50 is subjected to positioning in the second direction with respect to the main body 10. Incidentally, when each of the engagement protrusions A3 and B3 is removed from a position between the corresponding pressure lever 110 and positioning protrusion 15, the pressure lever 110 contacts the positioning protrusion 15, so that the pressure lever 110 is maintained at the initial position.

Further, the first frame 55A includes a counterpart support portion A4, a bearing 52A, and a compression coil spring 52C. The first frame 55A is formed with a guide hole 52B. The second frame 55B includes a counterpart support portion B4. Each of the counterpart support portions A4 and B4 is supported by the corresponding support portion 17 in the state where the transfer belt unit 50 is attached to the main body 10.

The counterpart support portion A4 is positioned between the engagement protrusion A3 and the handle C1. The counterpart support portion B4 is positioned between the engagement protrusion B3 and the handle C1. The bearing 52A rotatably supports the follower roller 52. The bearing 52A is positioned at the one end portion of the first frame 55A in the second direction. The guide hole 52B supports the bearing 52A so that the bearing 52A is movable in the second direction. The compression coil spring 52C urges the bearing 52A in the direction from the other side toward the one side in the second direction.

Figure 5:
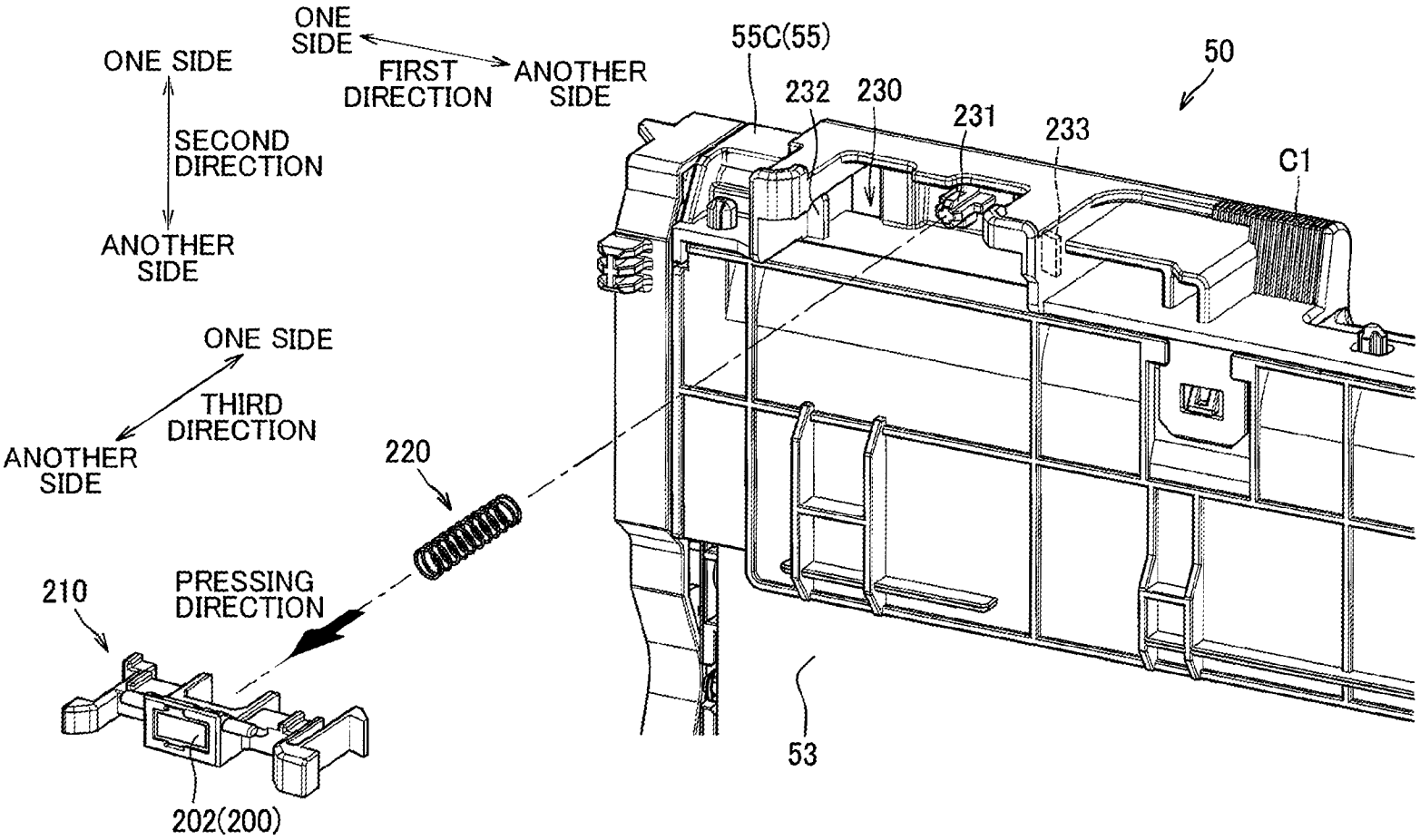
FIG. 5 is an exploded perspective view illustrating a holder and a holder retaining portion.

As illustrated in FIG. 5, the transfer belt unit 50 further includes a belt memory 200, a holder 210, a pressing member 220, and a holder retaining portion 230. The belt memory 200 is held by the holder 210. That is, a storage element 201 (described later) and an electrical contact surface 202 (described later) of the belt memory 200 are held by the holder 210. The holder 210 is held by the holder retaining portion 230 so as to be movable. The holder retaining portion 230 is positioned at the belt frame 55.

Specifically, the holder retaining portion 230 is positioned at the third frame 55C of the belt frame 55 (see also FIG. 2). The holder retaining portion 230 is positioned at one side portion of the third frame 55C in the first direction, the one side portion being at the one side in the first direction. In a state where the holder 210 is attached to the transfer belt unit 50, the holder 210 is positioned closer to the follower roller 52 than to the drive roller 51 in the second direction. Further, the holder 210 is positioned closer to one end portion of the belt frame 55 in the first direction at which the belt electrodes 57 are not positioned (i.e., the one end portion of the belt frame 55 in the first direction in FIG. 2) than to another end portion of the belt frame 55 in the first direction at which the belt electrodes 57 are positioned (i.e., the other end portion of the belt frame 55 in the first direction in FIG. 2).

The holder retaining portion 230 provides a generally rectangular parallelepiped space which is slightly larger than the size of the holder 210. The holder retaining portion 230 includes a first protrusion 231, a second protrusion 232, and a third protrusion 233.

The first protrusion 231 extends, from the inner wall of the holder retaining portion 230, in a direction from the one side toward the other side in the third direction. In the present embodiment, the first protrusion 231 extends downward from the inner wall. The second protrusion 232 extends from the inner surface in the direction from the one side toward the other side in the first direction. The third protrusion 233 extends from the inner wall in the direction from the other side toward the one side in the first direction. The third protrusion 233 is inclined so as to approach the other side from the one side in the third direction as extending in the direction from the one side toward the other side in the first direction.

Figure 6A:
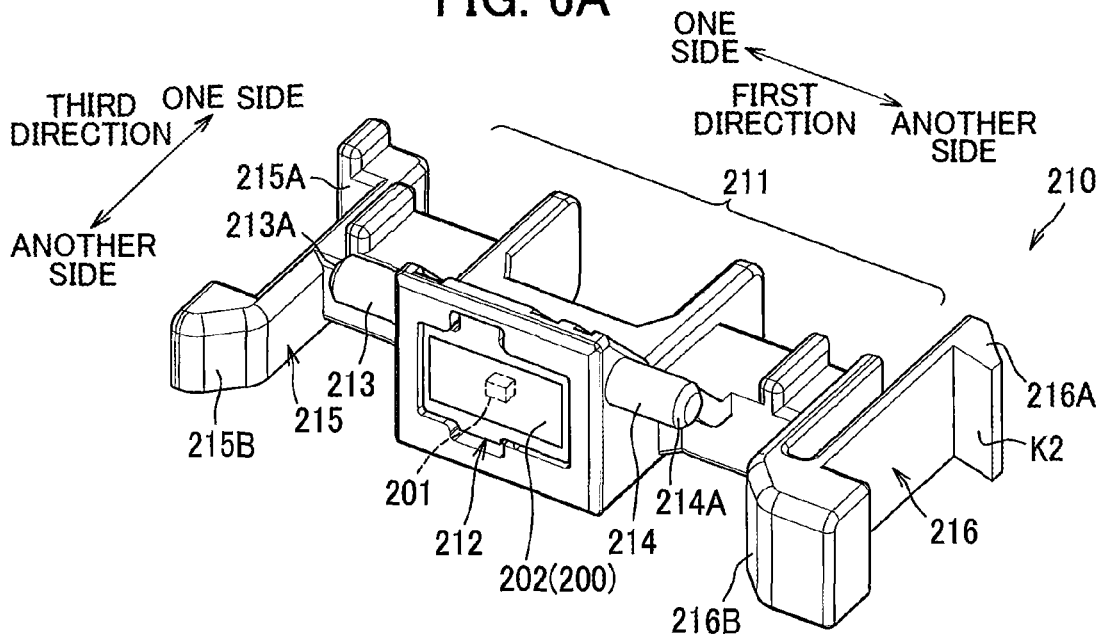
FIG. 6A is a perspective view illustrating the holder as viewed from below.

As illustrated in FIG. 6A, the belt memory 200 includes the storage element 201 and has the electrical contact surface 202. The electrical contact surface 202 is electrically connected to the storage element 201. In the present embodiment, the storage element 201 and the electrical contact surface 202 are positioned close to each other. However, the storage element 201 and the electrical contact surface 202 may be positioned distant from each other.

The storage element 201 of the belt memory 200 stores therein information on the transfer belt unit 50. Specifically, the storage element 201 of the belt memory 200 stores therein a conveying speed of the transfer belt 53 which is measured in advance. For example, as information on components that affect the conveying speed of the transfer belt 53, the storage element 201 of the belt memory 200 may store therein a thickness of the transfer belt 53, an outer diameter of the drive roller 51, and an outer diameter of the follower roller 52 which are measured in advance.

Further, the storage element 201 of the belt memory 200 may store therein at least one of: the manufacturing serial number of the transfer belt unit 50; the identification code for indicating that the transfer belt unit 50 is a genuine product; the models and specifications of image forming apparatuses compatible with the transfer belt unit 50; information for indicating the service life of the transfer belt 53; information for indicating whether the transfer belt 53 is a new product; the cumulative number of rotations of the transfer belt 53; the cumulative number of sheets printed using the transfer belt 53; and the error history of the transfer belt 53.

Figure 6B:
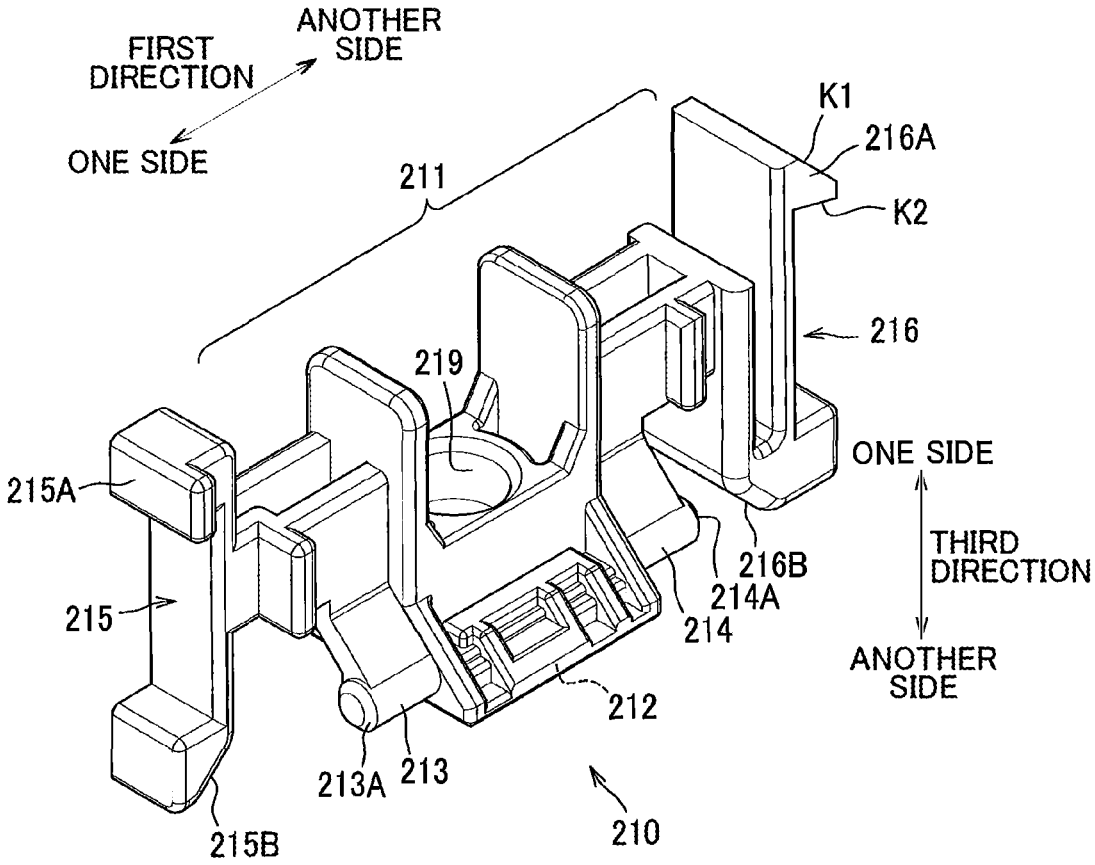
FIG. 6B is a perspective view illustrating the holder as viewed from above.

As illustrated in FIGS. 6A and 6B, the holder 210 includes a body portion 211, a memory holding portion 212, a first protrusion 213, a second protrusion 214, a first guide 215, and a second guide 216 and is formed with a hole 219.

Each of the first protrusion 213 and the second protrusion 214 is an example of a protrusion which enters a groove of the main body 10 (a first groove 312 and a second groove 313 in FIG. 10, described later) to fix a position of the memory holding portion 212 with respect to the main body 10. In the following description, directions referred to are based on the state where the transfer belt unit 50 is attached to the main body 10.

The body portion 211 has one end portion and another end portion in the first direction, the one end portion being at the one side in the first direction, the other end portion being at the other side in the first direction. The body portion 211 also has one end portion and another end portion in the third direction, the one end portion being at the one side in the third direction, the other end portion being at the other side in the third direction.

The memory holding portion 212 is positioned at the other end portion of the body portion 211 in the third direction. The memory holding portion 212 holds the belt memory 200. That is, the memory holding portion 212 holds both the storage element 201 and the electrical contact surface 202. The hole 219 is positioned at the body portion 211. One end portion of the pressing member 220 is configured to be inserted in the hole 219.

The first protrusion 213 and the second protrusion 214 protrude from the body portion 211 of the holder 210 in the first direction. The first protrusion 213 protrudes from the body portion 211 in the direction from the other side toward the one side in the first direction. The first protrusion 213 has a solid cylindrical shape. The first protrusion 213 has a tip end portion having a tapered surface 213A. The second protrusion 214 protrudes from the body portion 211 in the direction from the one side toward the other side in the first direction. The second protrusion 214 has a solid cylindrical shape. The second protrusion 214 has a tip end portion having a tapered surface 214A.

The first guide 215 extends, from the one end portion of the body portion 211 in the first direction, in the direction from the other side toward the one side in the third direction and in the direction from the one side toward the other side in the third direction. The first guide 215 includes a first hook 215A and has a sloped surface 215B. The first guide 215 has one end portion and another end portion in the third direction, the one end portion being at the one side in the third direction, the other end portion being at the other side in the third direction.

The first hook 215A is positioned at the one end portion of the first guide 215 in the third direction. The first hook 215A extends, from the one end portion of the first guide 215 in the third direction, in the direction from the other side toward the one side in the first direction.

The sloped surface 215B of the first guide 215 is positioned at the other end portion of the first guide 215 in the third direction. The sloped surface 215B is inclined so as to approach the one side from the other side in the third direction as extending in the direction from the one side toward the other side in the first direction.

The second guide 216 extends, from the other end portion of the body portion 211 in the first direction, in the direction from the other side toward the one side in the third direction. The second guide 216 includes a second hook 216A and has a sloped surface 216B. The second guide 216 has one end portion and another end portion in the third direction, the one end portion being at the one side in the third direction, the other end portion being at the other side in the third direction.

The second hook 216A is positioned at the one end portion of the second guide 216 in the third direction. The second hook 216A extends, from the one end portion of the second guide 216 in the third direction, in the direction from the one side toward the other side in the first direction. The second hook 216A has a first hook surface K1 and a second hook surface K2.

The first hook surface K1 faces in the direction from the other side toward the one side in the third direction. The first hook surface K1 is inclined so as to approach the other side in the third direction as extending in the direction from the one side toward the other side in the first direction. The first hook surface K1 is configured to abut on the third protrusion 233 in a case where the holder 210 is attached to the holder retaining portion 230. This abutment causes the second guide 216 to be bent. This configuration enables the holder 210 to be assembled to the holder retaining portion 230 by pushing the holder 210 into the holder retaining portion 230.

The second hook surface K2 faces in the direction from the one side toward the other side in the third direction. The second hook surface K2 is inclined so as to approach the other side in the third direction as extending in the direction from the one side toward the other side in the first direction.

The sloped surface 216B of the second guide 216 is positioned at the other end portion of the second guide 216 in the third direction. The sloped surface 216B is inclined so as to approach the one side in the third direction as extending in the direction from the other side toward the one side in the first direction.

Figure 7:
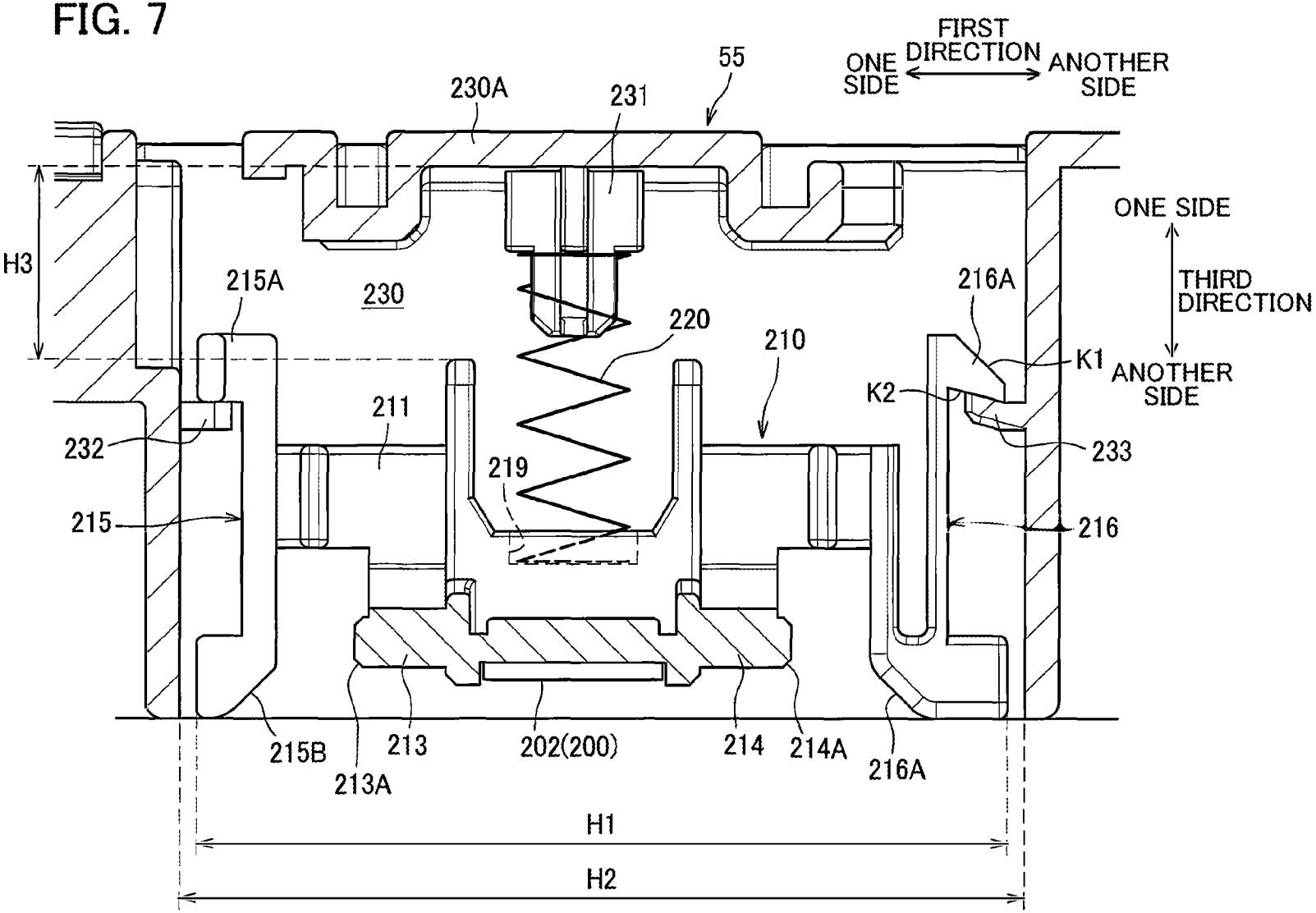
FIG. 7 is a cross-sectional view taken along a plane perpendicular to a second direction and illustrating the holder and the periphery thereof.

As illustrated in FIG. 7, in a case where the holder 210 is held by the holder retaining portion 230, the first hook 215A is hooked to the second protrusion 232 of the holder retaining portion 230 and the second hook 216A is hooked to the third protrusion 233 of the holder retaining portion 230. Each of the first hook 215A and the second hook 216A is an example of a retainer which is hooked to the belt frame 55 to prevent the holder 210 from being detached from the belt frame 55.

A length H1 in the first direction of the holder 210 is smaller than a distance H2 in the first direction between the inner walls of the holder retaining portion 230. Hence, in a case where the holder 210 is held by the holder retaining portion 230, a gap in the first direction is provided between the holder 210 and the holder retaining portion 230. Hence, the holder 210 is movable in the first direction relative to the belt frame 55 by the length of the gap.

A gap H3 is provided between the holder 210 and an upper wall 230A of the holder retaining portion 230 in the case where the holder 210 is held by the holder retaining portion 230. The upper wall 230A is positioned at one end portion of the holder retaining portion 230 in the third direction, the one end portion being at the one side in the third direction. Hence, the holder 210 is movable in the third direction relative to the belt frame 55 by the length of the gap H3.

Figure 8:
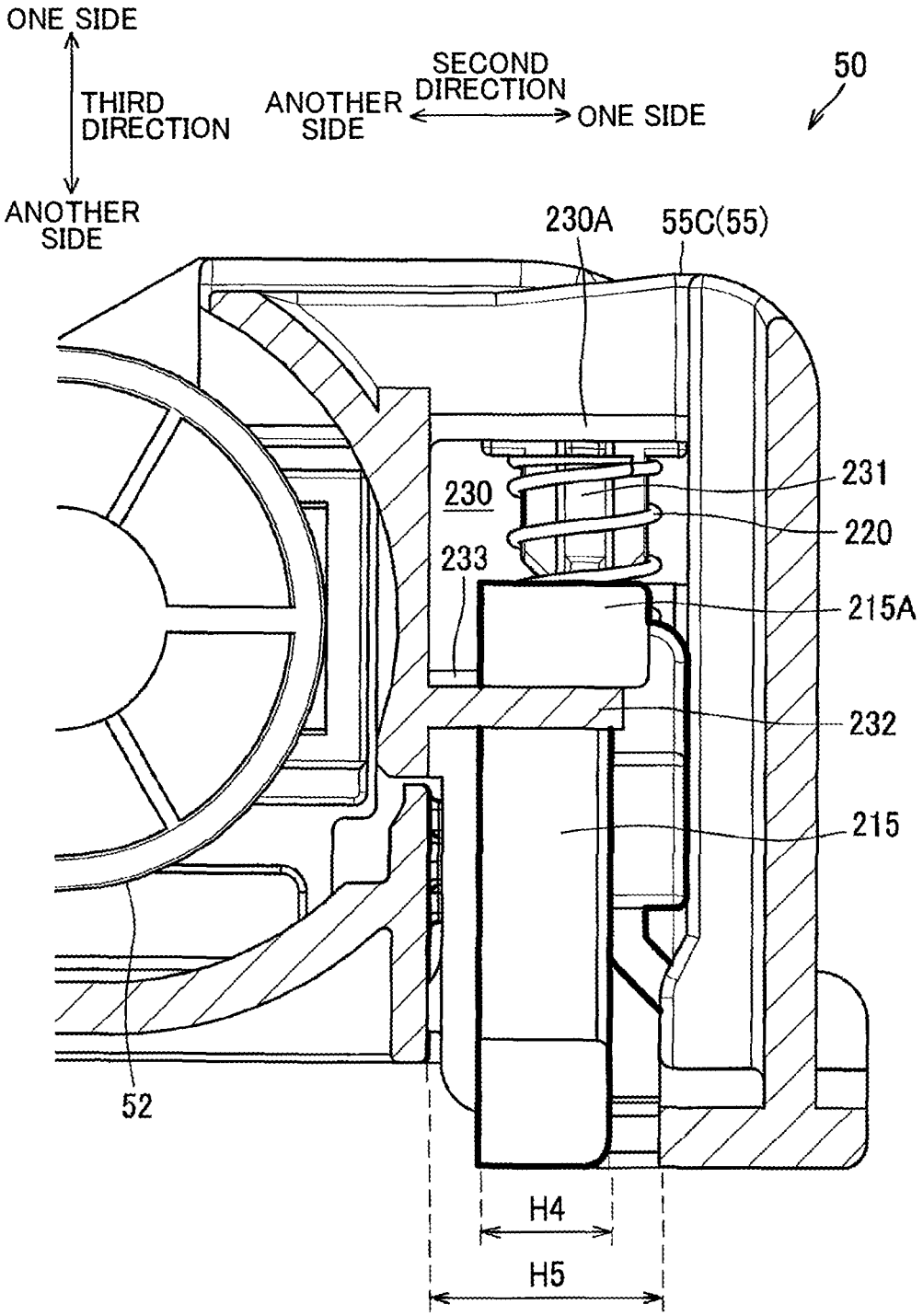
FIG. 8 is a cross-sectional view taken along a plane perpendicular to a first direction and illustrating the holder and the periphery thereof.

As illustrated in FIG. 8, a length H4 in the second direction of the holder 210 is smaller than a distance H5 in the second direction between the inner walls of the holder retaining portion 230. Hence, a gap in the second direction is provided between the holder 210 and the holder retaining portion 230 in the case where the holder 210 is held by the holder retaining portion 230. Hence, the holder 210 is movable in the second direction relative to the belt frame 55 by the length of the gap.

According to the present embodiment, the holder 210 is movable in the first direction and the second direction. In other words, the holder 210 is movable relative to the belt frame 55 in a direction crossing a pressing direction (the third direction). That is, the holder 210 is movable relative to the belt frame 55 in at least one direction parallel to the electrical contact surface 202.

In the present embodiment, the holder 210 is movable also in the third direction as well as in the first and second directions. As illustrated in FIGS. 7 and 8, the pressing member 220 is positioned between the belt frame 55 and the holder 210. Specifically, the pressing member 220 is positioned between the holder 210 and the upper wall 230A of the holder retaining portion 230 which is a part of the belt frame 55.

As illustrated in FIG. 7, the pressing member 220 has one end portion engaged with the first protrusion 231, and another end portion inserted in the hole 219. The pressing member 220 presses the holder 210 in a direction away from the belt frame 55. The pressing member 220 presses the electrical contact surface 202 in the pressing direction (i.e., in the direction of an arrow shown in FIG. 5). The pressing direction is the direction from the one side toward the other side in the third direction. In the present embodiment, the pressing member 220 is a spring, and more specifically a compression spring.

Figure 9:
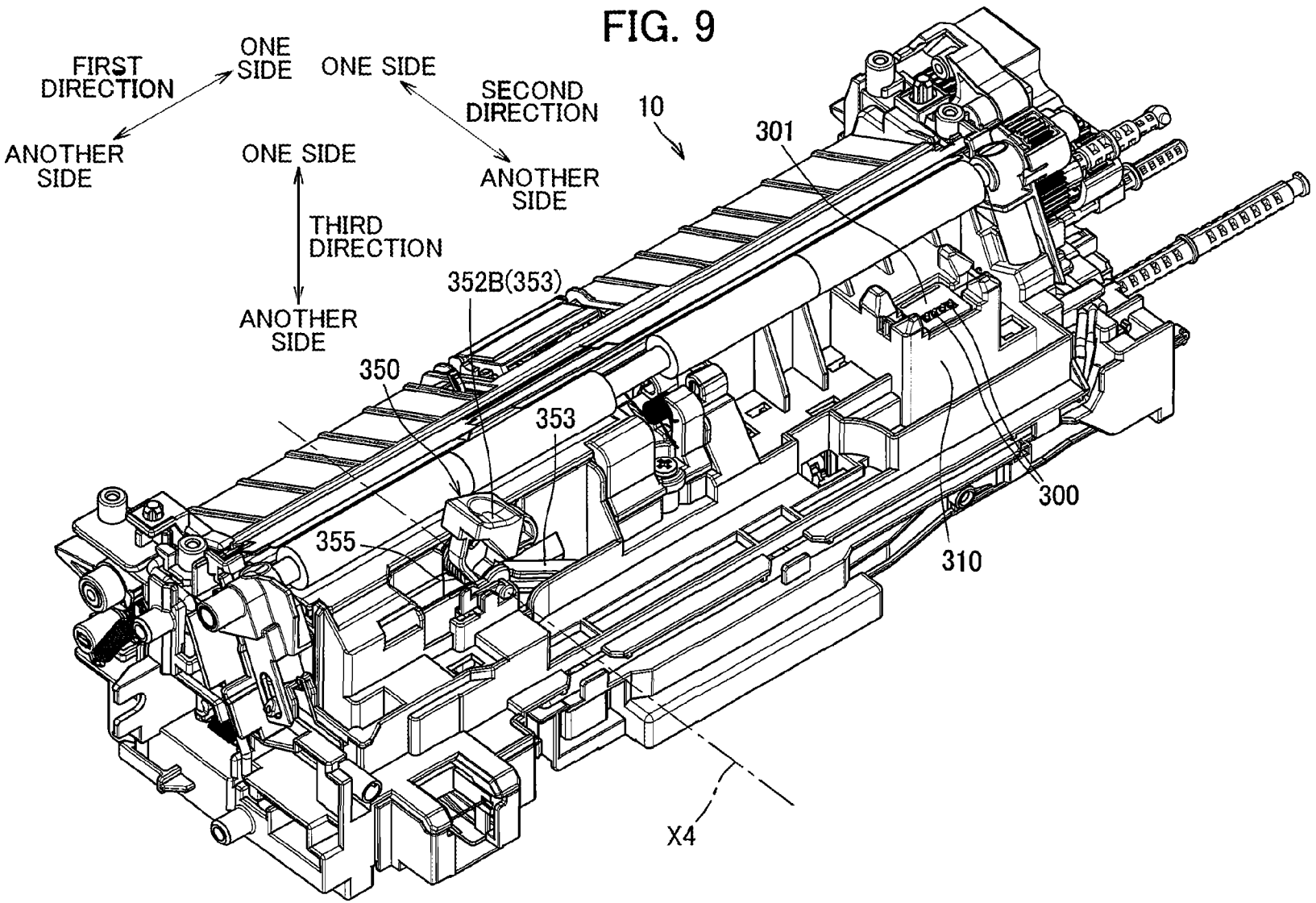
FIG. 9 is a perspective view for describing positions of an electrical contact and a lever in a main body of the image forming apparatus.
Figure 14A:
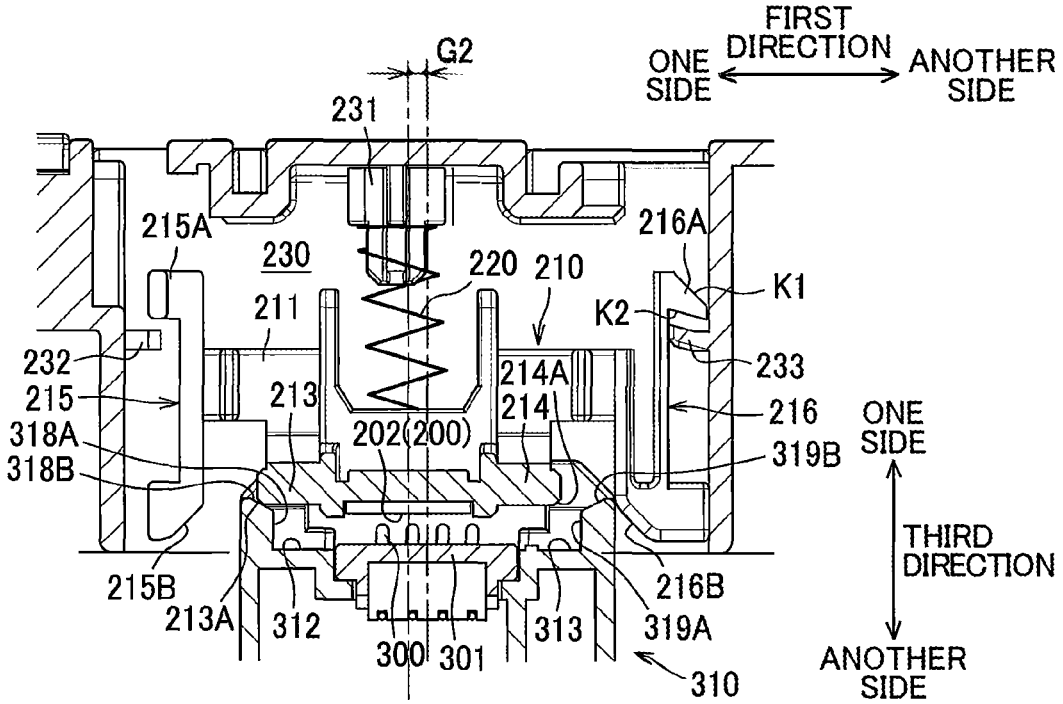
FIG. 14A is a view for describing the action when the transfer belt unit is attached to the main body, and particularly illustrating a state where a protrusion is being guided by a first sloped surface.
Figure 14B:
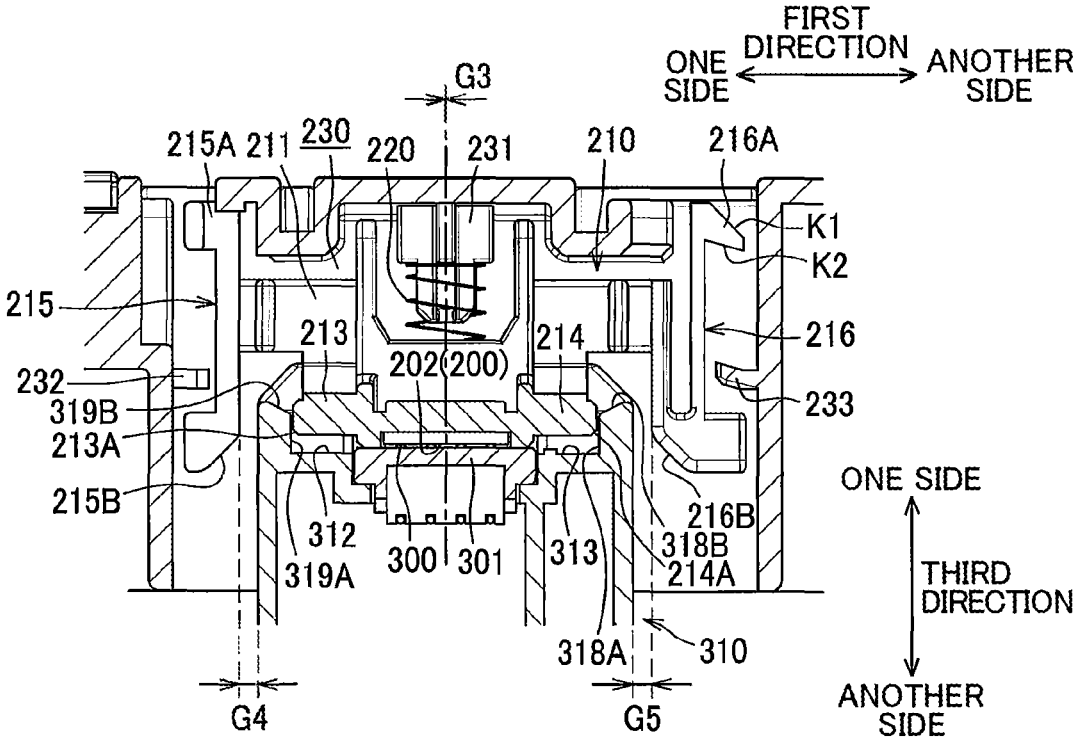
FIG. 14B is a view for describing the action when the transfer belt unit is attached to the main body, and particularly illustrating a state the transfer belt unit is attached to the main body.

As illustrated in FIG. 9, the main body 10 includes an electrical contact 300, a contact member 301, a contact holder 310, and a lever 350. The electrical contact 300 is held by the contact holder 310. Specifically, the electrical contact 300 is held by the contact member 301 so as to be movable in the third direction. Hence, when the electrical contact 300 is brought into contact with the electrical contact surface 202 of the belt memory 200, the electrical contact 300 is movable in the third direction (as illustrated in FIGS. 14A and 14B) by being pressed by the electrical contact surface 202. The contact member 301 is held by the contact holder 310. The contact holder 310 is held by the main body 10.

The electrical contact 300 is positioned at one end portion of the main body 10 in the first direction, the one end portion being at the one side in the first direction. The electrical contact 300 is configured to be in electrical contact with the electrical contact surface 202 of the belt memory 200 in the state where the transfer belt unit 50 is attached to the main body 10. The electrical contact 300 is electrically connected to a main body circuit board 360 (FIG. 3A).

Figure 10:
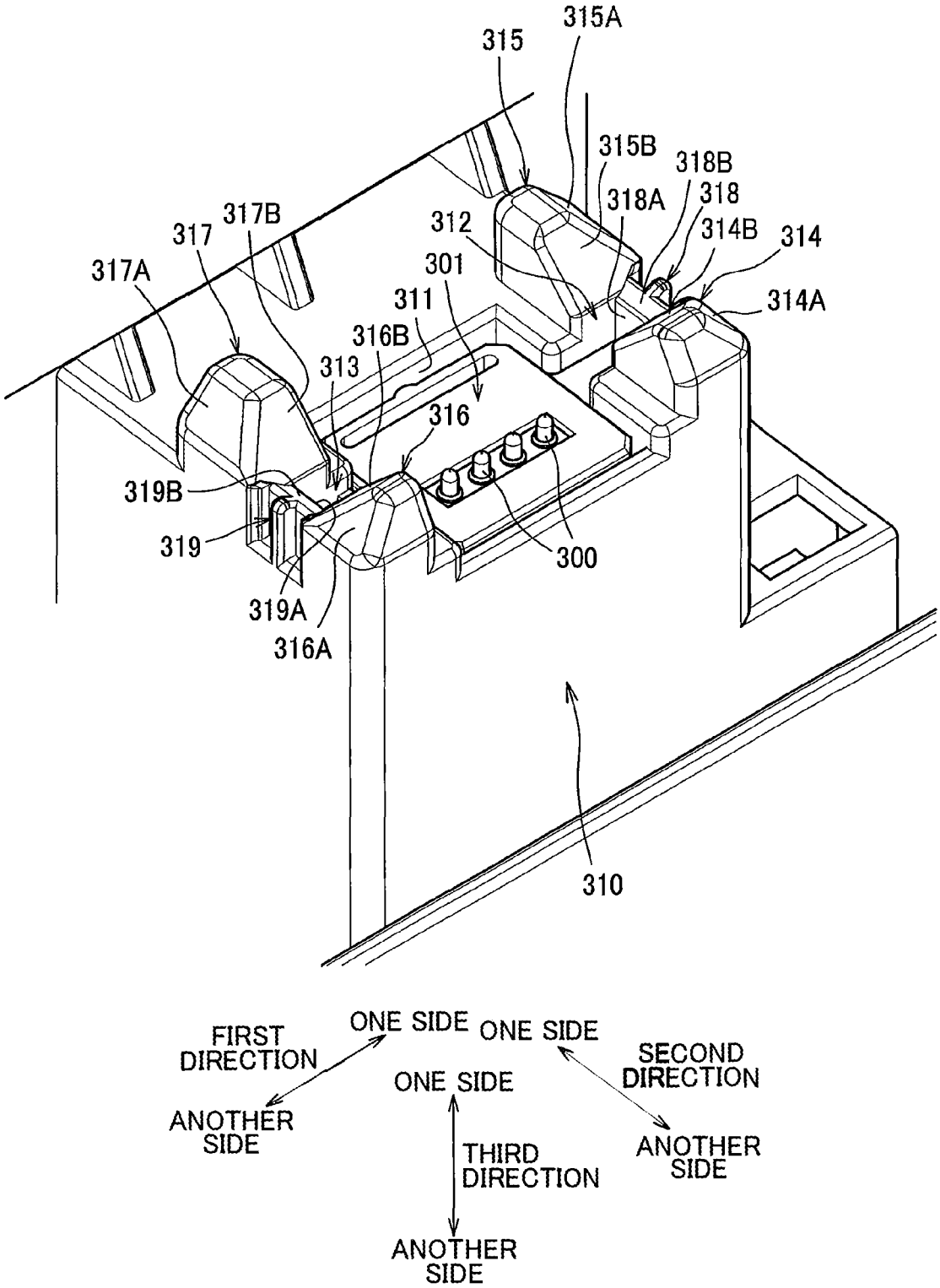
FIG. 10 is an enlarged perspective view illustrating the electrical contact and the periphery thereof in the main body.

As illustrated in FIG. 10, the contact holder 310 includes an electrical contact holding portion 311, a third guide 314, a fourth guide 315, a fifth guide 316, a sixth guide 317, a first wall 318, and a second wall 319, and is formed with the first groove 312, and the second groove 313.

The electrical contact holding portion 311 is a recessed portion for holding the contact member 301. The electrical contact holding portion 311 holds the contact member 301 so that the contact member 301 cannot move relative to the main body 10. Each of the first groove 312 and the second groove 313 is an example of a groove for fixing a position of the holder 210 relative to the main body 10 by the protrusion of the holder 210 (the first protrusion 213 and the second protrusion 214) entering the groove. Each of the third guide 314, the fourth guide 315, the fifth guide 316, and the sixth guide 317 is a guide protruding in the direction from the other side toward the one side in the third direction.

The fourth guide 315 is positioned at one side of the first groove 312 in the second direction, while the third guide 314 is positioned at another side of the first groove 312 in the second direction, the one side of the first groove 312 being at the one side in the second direction, the other side of the first groove 312 being at the other side in the second direction.

The third guide 314 has a first guide surface 314A and a second guide surface 314B. The first guide surface 314A and the second guide surface 314B are inclined with respect to the electrical contact surface 202 of the belt memory 200 in the state where the transfer belt unit 50 is attached to the main body 10. The first guide surface 314A and the second guide surface 314B are configured to guide the holder 210.

Specifically, the first guide surface 314A is configured to guide the sloped surface 215B of the first guide 215 of the holder 210, and the second guide surface 314B is configured to guide the first protrusion 213 of the holder 210. The first guide surface 314A is inclined so as to approach the one side in the third direction as extending in the direction from the one side toward the other side in the first direction. The second guide surface 314B is inclined so as to approach the one side in the third direction as extending in the direction from the one side toward the other side in the second direction.

The fourth guide 315 has a first guide surface 315A and a second guide surface 315B. The first guide surface 315A and the second guide surface 315B are inclined with respect to the electrical contact surface 202 of the belt memory 200 in the state where the transfer belt unit 50 is attached to the main body 10. The first guide surface 315A and the second guide surface 315B are configured to guide the holder 210.

Specifically, the first guide surface 315A is configured to guide the sloped surface 215B of the first guide 215 of the holder 210, and the second guide surface 315B is configured to guide the first protrusion 213 of the holder 210. The first guide surface 315A is inclined so as to approach the one side in the third direction as extending in the direction from the one side toward the other side in the first direction. The second guide surface 315B is inclined so as to approach the one side in the third direction as extending in the direction from the other side toward the one side in the second direction.

The sixth guide 317 is positioned at one side of the second groove 313 in the second direction, while the fifth guide 316 is positioned at another side of the second groove 313 in the second direction, the one side of the second groove 313 being at the one side in the second direction, the other side of the second groove 313 being at the other side in the second direction.

The fifth guide 316 has a first guide surface 316A and a second guide surface 316B. The first guide surface 316A and the second guide surface 316B are inclined with respect to the electrical contact surface 202 of the belt memory 200 in the state where the transfer belt unit 50 is attached to the main body 10. The first guide surface 316A and the second guide surface 316B are configured to guide the holder 210.

Specifically, the first guide surface 316A is configured to guide the sloped surface 216B of the second guide 216 of the holder 210, and the second guide surface 316B is configured to guide the second protrusion 214 of the holder 210. The first guide surface 316A is inclined so as to approach the one side in the third direction as extending in the direction from the other side toward the one side in the first direction. The second guide surface 316B is inclined so as to approach the one side in the third direction as extending in the direction from the one side toward the other side in the second direction.

The sixth guide 317 has a first guide surface 317A and a second guide surface 317B. The first guide surface 317A and the second guide surface 317B are inclined with respect to the electrical contact surface 202 of the belt memory 200 in the state where the transfer belt unit 50 is attached to the main body 10. The first guide surface 317A and the second guide surface 317B are configured to guide the holder 210.

Specifically, the first guide surface 317A is configured to guide the sloped surface 216B of the second guide 216 of the holder 210, and the second guide surface 317B is configured to guide the second protrusion 214 of the holder 210. The first guide surface 317A is inclined so as to approach the one side in the third direction as extending in the direction from the other side toward the one side in the first direction. The second guide surface 317B is inclined so as to approach the one side in the third direction as extending in the direction from the other side toward the one side in the second direction.

The first wall 318 is a wall connecting the third guide 314 and the fourth guide 315. The first wall 318 has a first wall surface 318A and a third guide surface 318B. The first wall surface 318A is perpendicular to the first direction and faces in the direction from the one side toward the other side in the first direction. The third guide surface 318B extends from the first wall surface 318A. The third guide surface 318B is inclined so as to approach the one side in the third direction as extending in the direction from the other side toward the one side in the first direction.

The second wall 319 is a wall connecting the fifth guide 316 and the sixth guide 317. The second wall 319 has a first wall surface 319A and a third guide surface 319B. The first wall surface 319A is perpendicular to the first direction and faces in the direction from the other side toward the one side in the first direction. The third guide surface 319B extends from the first wall surface 319A. The third guide surface 319B is inclined so as to approach the one side in the third direction as extending in the direction from the one side toward the other side in the first direction.

The first groove 312 is a groove formed between the third guide 314, the fourth guide 315, and the first wall 318. The first groove 312 extends from the electrical contact holding portion 311 in the direction from the other side toward the one side in the first direction.

The second groove 313 is a groove formed between the fifth guide 316, the sixth guide 317, and the second wall 319. The second groove 313 extends from the electrical contact holding portion 311 in the direction from the one side toward the other side in the first direction.

Each of the third guide surface 318B of the first wall 318, the third guide surface 319B of the second wall 319, the second guide surface 314B of the third guide 314, the second guide surface 315B of the fourth guide 315, the second guide surface 316B of the fifth guide 316, and the second guide surface 317B of the sixth guide 317 is an example of a first sloped surface configured to guide the protrusion (the first protrusion 213 and the second protrusion 214) of the holder 210 to the groove (the first groove 312 and the second groove 313) of the contact holder 310.

Each of the first guide surface 314A of the third guide 314, the first guide surface 315A of the fourth guide 315, the first guide surface 316A of the fifth guide 316, and the first guide surface 317A of the sixth guide 317 is an example of a second sloped surface configured to guide the protrusion (the first protrusion 213 and the second protrusion 214) of the holder 210 to the first sloped surface of the contact holder 310.

Figure 11:
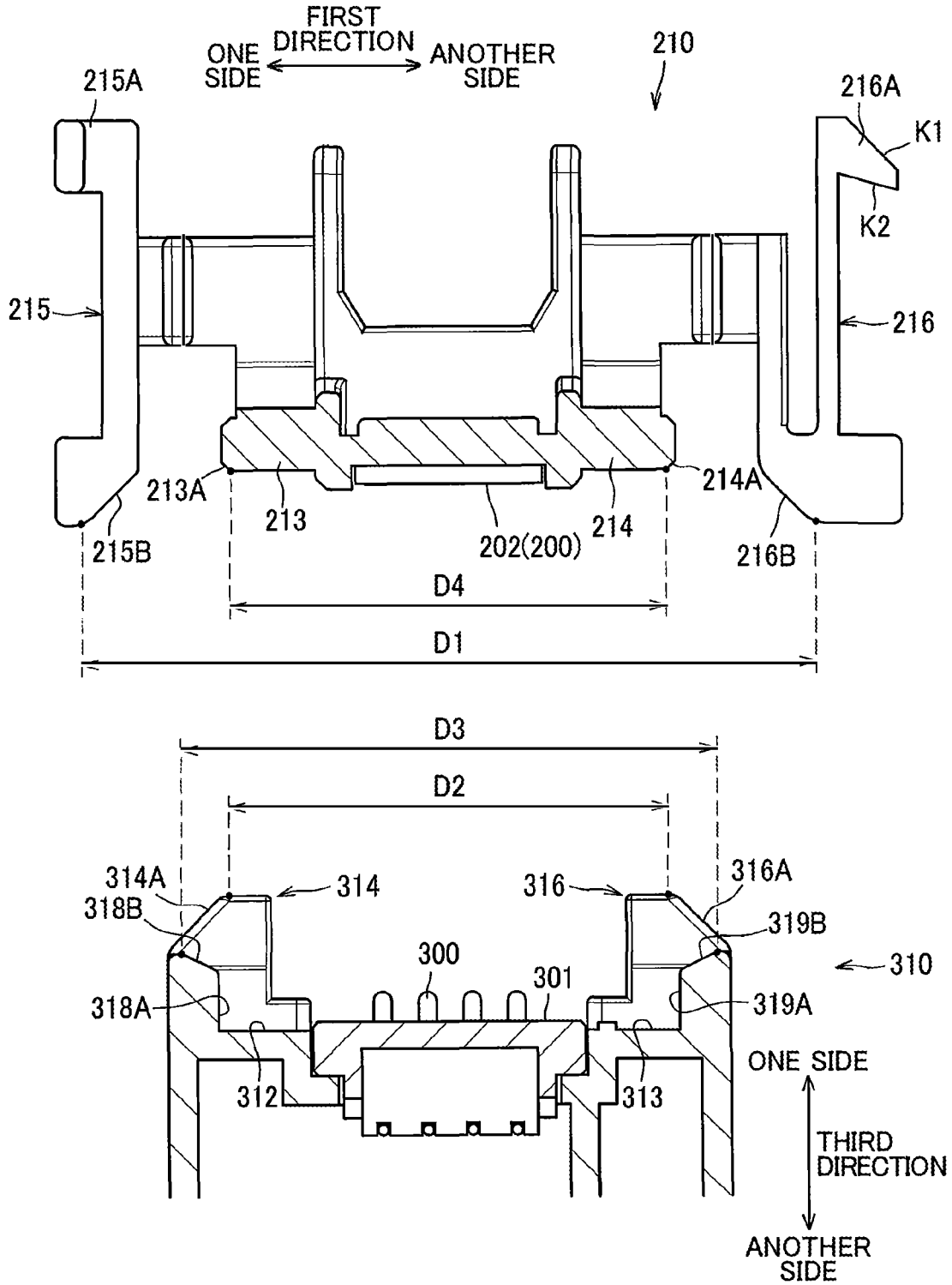
FIG. 11 is a view for describing a range within which a contact holder can guide the holder.

Next, description will be made, while referring to FIG. 11, to a range within which the holder 210 can be guided by the guide surfaces to a predetermined position in a case where the holder 210 is displaced from the contact holder 310 in the first direction.

In a case where the sloped surfaces 215B, 216B of the holder 210 is guided by contacting the first guide surfaces 314A, 315A, 316A, 317A, a displacement amount (hereinafter, referred to as "permissible displacement amount") in the first direction when the holder 210 is most displaced in the direction from the other side toward the one side in the first direction and when the holder 210 is most displaced in the direction from the one side toward the other side in the first direction, is represented by the equation "(D1−D2)/2", in which D1 is a distance in the first direction between the farthest portions of the sloped surfaces 215B and 216B from each other in the first direction, and D2 is a distance in the first direction between the closest portions of the first guide surfaces 314A and 316A to each other in the first direction (or between the closest portions of the first guide surfaces 315A and 317A to each other in the first direction).

In a case where the tapered surface 213A of the first protrusion 213 or the tapered surface 214A of the second protrusion 214 is guided by contacting the third guide surface 318B or the third guide surface 319B, the permissible displacement amount in the first direction of the holder 210 is represented by the equation "(D3−D4)/2", in which D3 is a distance in the first direction between the farthest portions of the third guide surfaces 318B and 319B from each other in the first direction, and D4 is a distance in the first direction between the closest portions of the tapered surfaces 213A and 214A to each other in the first direction.

In the present embodiment, the permissible displacement amount "(D1−D2)/2" when the holder 210 is guided by the first guide surfaces 314A, 315A, 316A, 317A is greater than the permissible displacement amount "(D3−D4)/2" when the holder 210 is guided by the third guide surfaces 318B, 319B. Therefore, the first guide surfaces 314A, 315A, 316A, 317A can more roughly correct displacement in the first direction of the holder 210 than the third guide surfaces 318B, 319B can.

Figure 12A:
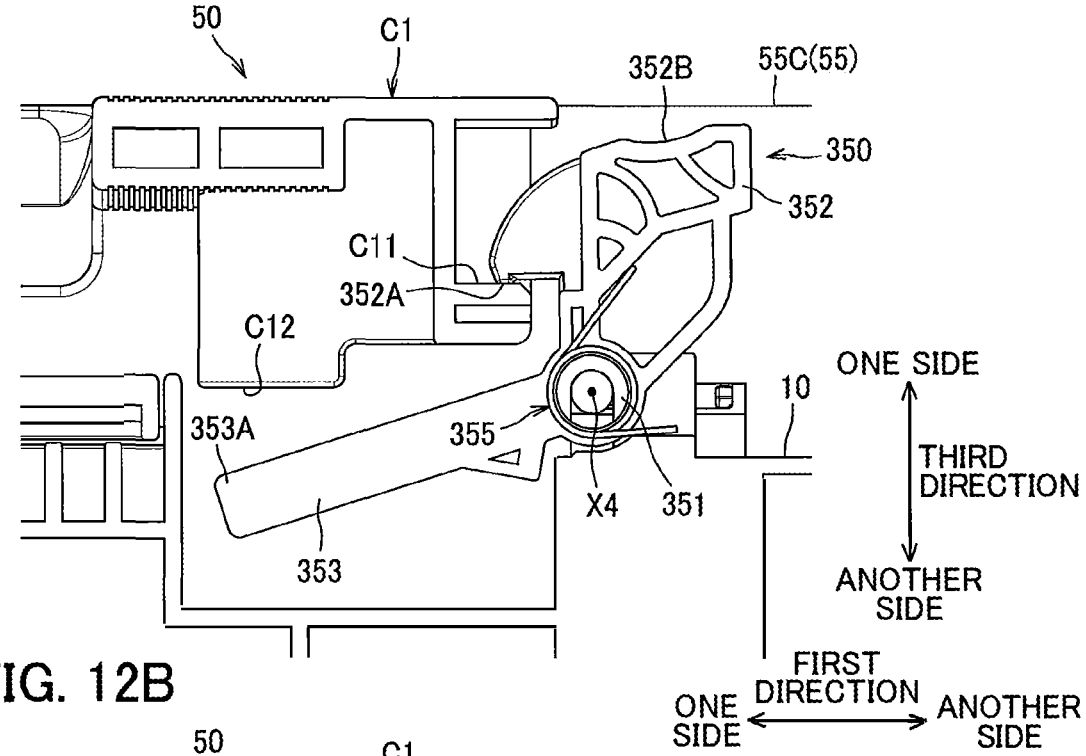
FIG. 12A is a view illustrating the lever positioned at a first position.
Figure 12B:
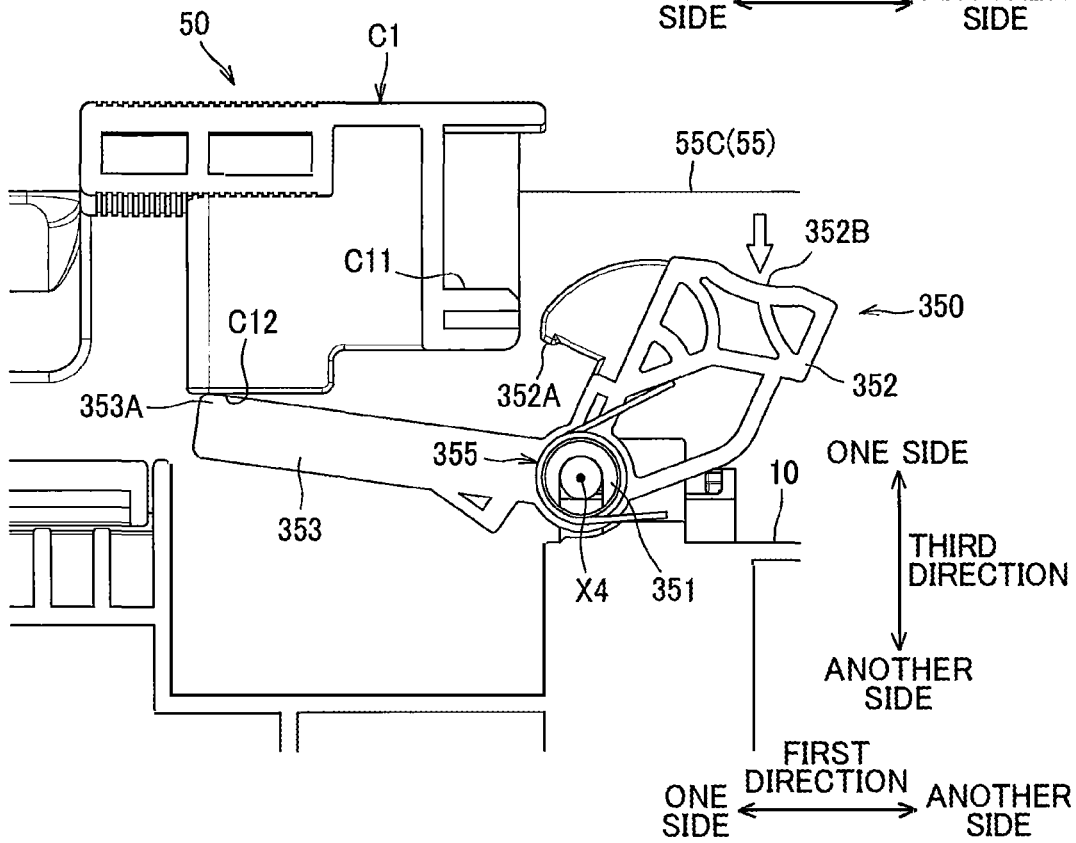
FIG. 12B is a view illustrating the lever positioned at a second position.

The lever 350 is pivotally movable between a first position illustrated in FIG. 12A and a second position illustrated in FIG. 12B. The lever 350 is pivotally movable about a lever axis X4 extending in the second direction (see also FIG. 9). The lever 350 is always urged from the second position toward the first position by a torsion spring 355.

As illustrated in FIGS. 12A and 12B, the lever 350 includes a pivot shaft 351, a first arm 352, and a second arm 353.

The pivot shaft 351 extends in the second direction, and is rotatable about the lever axis X4.

The first arm 352 has a lock surface 352A and a tip end portion 352B. The first arm 352 extends from an outer peripheral surface of the pivot shaft 351. The tip end portion 352B and the handle C1 is arrayed in the first direction. The user can touch the tip end portion 352B.

As illustrated in FIG. 12A, in a state where the lever 350 is at the first position, the lock surface 352A is in contact with a part of the transfer belt unit 50 to lock the transfer belt unit 50 at the contacting position. Specifically, in the state where the lever 350 is at the first position, the lock surface 352A is in contact with an upper surface C11 of the handle C1. In the present embodiment, the upper surface C11 is one side surface of a groove formed in the handle C1.

On the other hand, as illustrated in FIG. 12B, in a state where the lever 350 is at the second position, the lock surface 352A is out of contact with the part of the transfer belt unit 50 (specifically, the upper surface C11 of the handle C1), and hence the lever 350 does not lock the transfer belt unit 50 at the contacting position.

The second arm 353 extends from the outer peripheral surface of the pivot shaft 351 in a direction different from the extending direction of the first arm 352. The second arm 353 is positioned spaced away from the first arm 352 in the pivotal movement direction of the lever 350.

As illustrated in FIG. 12A, in the state where the lever 350 is at the first position, a tip end portion 353A of the second arm 353 is out of contact with a part of the transfer belt unit 50. On the other hand, in the state where the lever 350 is at the second position as illustrated in FIG. 12B, the tip end portion 353A of the second arm 353 is in contact with the part of the transfer belt unit 50. Specifically, in the state where the lever 350 is at the second position, the tip end portion 353A of the second arm 353 is in contact with a lower surface C12 of the handle C1. The lower surface C12 of the handle C1 is a surface of the other end portion of the handle C1 in the third direction. In the state where the lever 350 is at the second position, the lever 350 separates the electrical contact surface 202 from the electrical contact 300.

When the user pushes the tip end portion 352B of the first arm 352 in the state where the lever 350 is at the first position, the lever 350 is pivotally moved from the first position to the second position. Hence, the second arm 353 pushes up the transfer belt unit 50 to the separated position, whereupon the electrical contact surface 202 is separated from the electrical contact 300. In this way, when the first arm 352 is pushed, the contact of the part of the transfer belt unit 50 with the lock surface 352A is released and at the same time, the second arm 353 pushes up the transfer belt unit 50.

Figure 4:
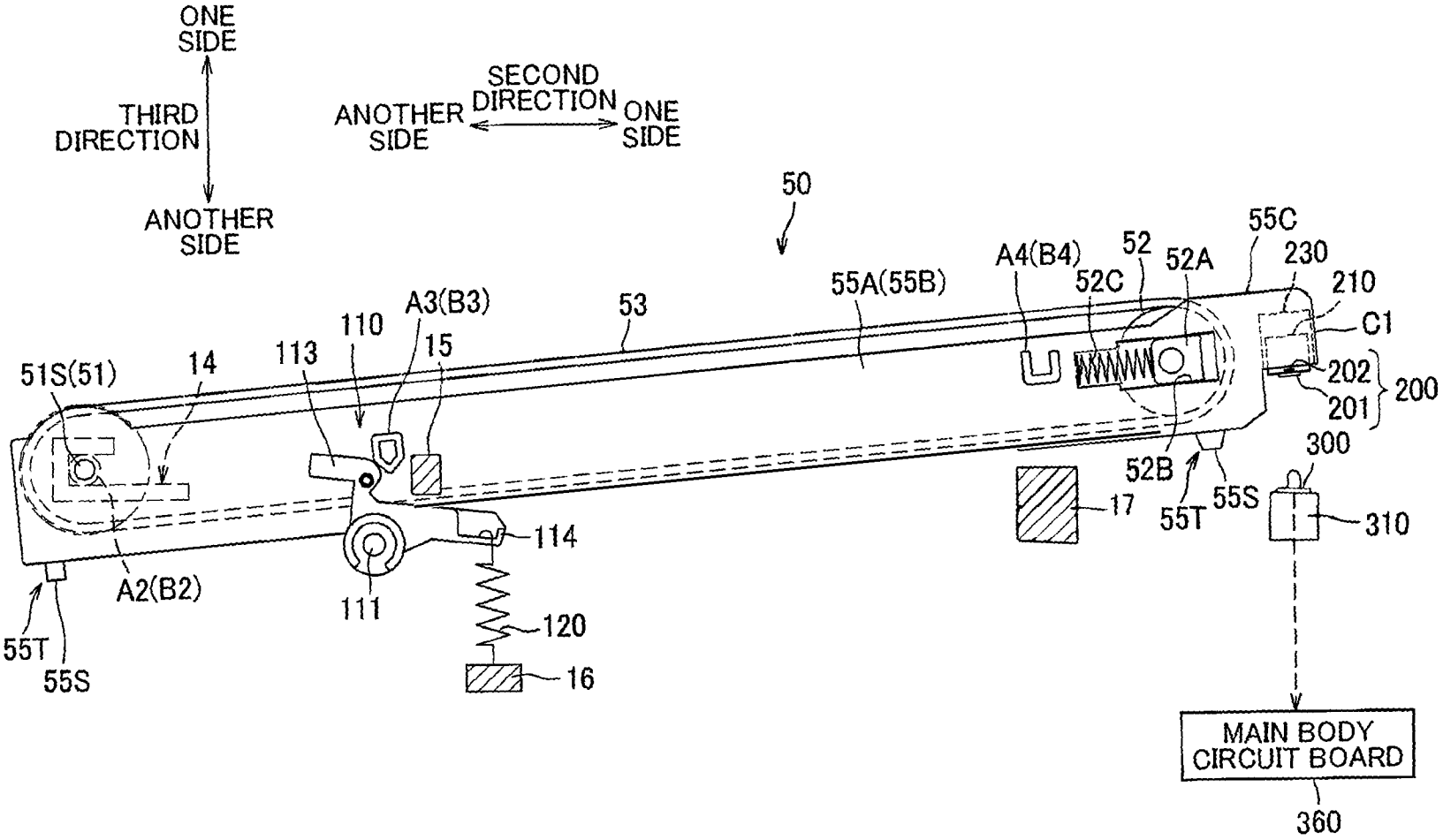
FIG. 4 is a schematic side view illustrating a state where the transfer belt unit illustrated in FIG. 3A is positioned at a separated position.

Operation for attachment of the transfer belt unit 50 will next be described. For attaching the transfer belt unit 50 to the main body 10, the user first grips the handle C1 and inserts the transfer belt unit 50 into an interior of the main body 10, as illustrated in FIG. 4. At this time, the user inserts the bearings A2 and B2 into the restricting portions 14.

Then, the user pivotally moves the transfer belt unit 50 about the axis X1 of the drive roller 51. As a result, each of the engagement protrusions A3 and B3 is abutted on the guide portion 113 of the corresponding pressure lever 110. Then, when the user further pivotally moves the transfer belt unit 50, each of the engagement protrusions A3 and B3 presses the guide portion 113 of the corresponding pressure lever 110 against the urging force of the corresponding tension coil springs 120. Hence, each of the pressure levers 110 is pivotally moved from the initial position illustrated in FIG. 4 to the pressing position illustrated in FIG. 3A. At this time, each of the engagement protrusions A3 and B3 is inserted between the corresponding pressure lever 110 and positioning protrusion 15. Accordingly, the position of the transfer belt unit 50 with respect to the main body 10 is fixed in the second direction and at the same time, the electrical contact surface 202 is brought into contact with the electrical contact 300.

Here, when the electrical contact surface 202 is brought into contact with the electrical contact 300, the electrical contact surface 202 may be displaced from the predetermined position in the first direction and in the second direction. Operation to correct such displacement for positioning the electrical contact surface 202 at the predetermined position will next be described with reference to FIGS. 13A through 14B.

Figure 13A:
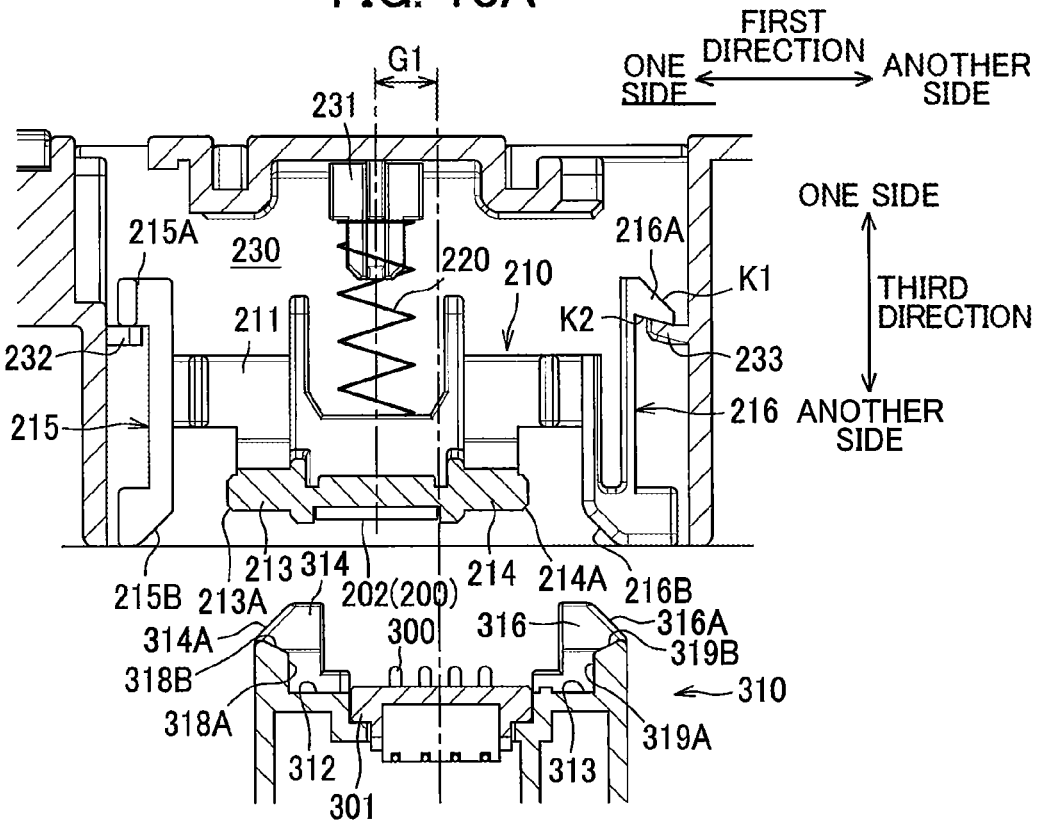
FIG. 13A is a view for describing the action when the transfer belt unit is attached to the main body, and particularly illustrating a state prior to contact of the holder with the contact holder.
Figure 13B:
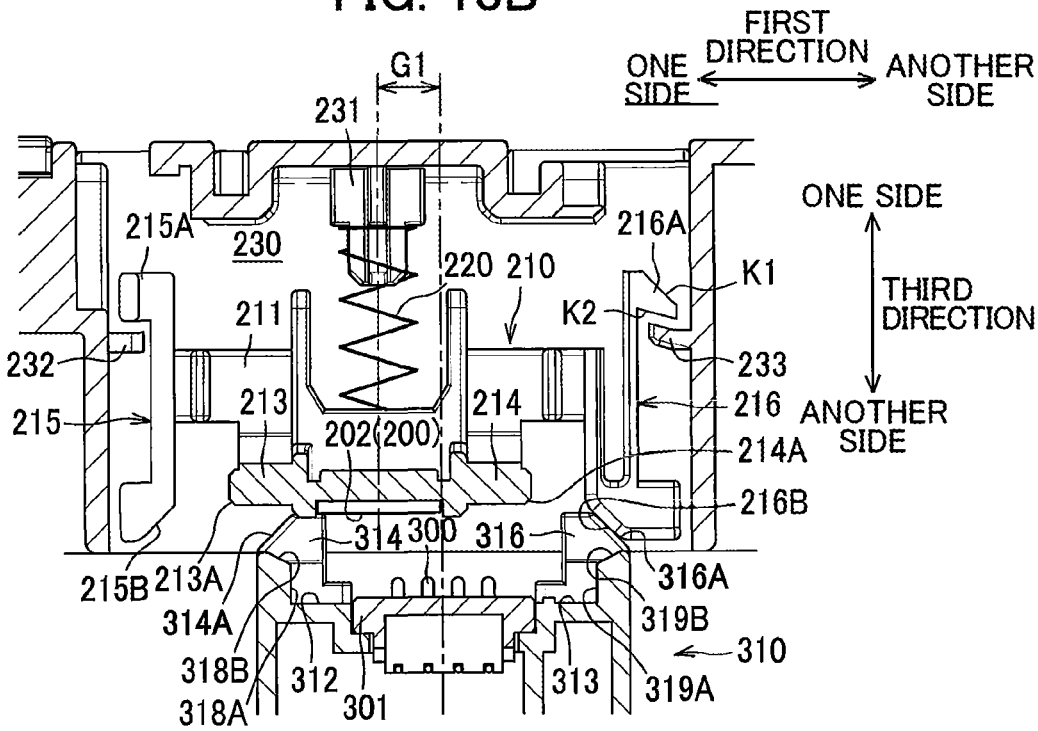
FIG. 13B is a view for describing the action when the transfer belt unit is attached to the main body, and particularly illustrating a state where the holder is being guided by a second sloped surface.

As illustrated in FIG. 13A, there may be an instance where the electrical contact surface 202 is displaced from the predetermined position relative to the electrical contact 300 by G1 in the direction from the other side toward the one side in the first direction. Starting from this state, when the transfer belt unit 50 is brought close to the main body 10, the sloped surface 216B of the second guide 216 contacts the first guide surface 316A of the fifth guide 316 or the first guide surface 317A of the sixth guide 317 as illustrated in FIG. 13B. Note that, in FIG. 13B, the first guide surface 316A of the fifth guide 316 appears but the first guide surface 317A of the sixth guide 317 does not appear. This contact causes the holder 210 to move in the direction from the one side toward the other side in the first direction.

Hence, the displacement amount G1 in the first direction between the electrical contact surface 202 and the electrical contact 300 is reduced, and as illustrated in FIG. 14A, the holder 210 is guided and moved to the position illustrated in FIG. 14A, so that the displacement amount becomes G2. In this way, the displacement amount is reduced from G1 to G2 and rough positioning of the holder 210 with respect to the contact holder 310 can be performed.

When the holder 210 has been guided to the position as illustrated in FIG. 14A, the tapered surface 213A of the first protrusion 213 is brought into contact with the third guide surface 318B of the first wall 318. This contact causes the holder 210 to further move in the direction from the one side toward the other side in the first direction. Hence, the displacement amount G3 in the first direction between the electrical contact surface 202 and the electrical contact 300 becomes almost zero as illustrated in FIG. 14B, and the first protrusion 213 enters the first groove 312 and the second protrusion 214 enters the second groove 313.

When the first protrusion 213 and the second protrusion 214 have entered the first groove 312 and the second groove 313, respectively, movements of the first protrusion 213 and the second protrusion 214 are restricted between the first wall surface 318A of the first wall 318 and the first wall surface 319A of the second wall 319. Thus, the position of the holder 210 in the first direction is fixed.

In a state where the first protrusion 213 and the second protrusion 214 are inserted in the first groove 312 and the second groove 313, respectively, and the position of the holder 210 is fixed, the sum of a gap in the first direction between the first protrusion 213 and the first groove 312 and a gap in the first direction between the second protrusion 214 and the second groove 313 is smaller than the sum of a gap in the first direction between the contact holder 310 and the first guide 215 of the holder 210 and a gap in the first direction between the contact holder 310 and the second guide 216 of the holder 210 (i.e., the total length in the first direction of a gap G4 and a gap G5).

Further, there may be an instance where the electrical contact surface 202 is displaced from the predetermined position relative to the electrical contact 300 in the direction from the one side toward the other side in the first direction. In this case, when the transfer belt unit 50 is brought close to the main body 10 from this state, the sloped surface 215B of the first guide 215 contacts the first guide surface 314A of the third guide 314 or the first guide surface 315A of the fourth guide 315 (this case is not illustrated in the drawings). This contact causes the holder 210 to move in the direction from the other side toward the one side in the first direction. As a result, the displacement amount in the first direction of the electrical contact surface 202 relative to the electrical contact 300 is reduced.

Then, the tapered surface 214A of the second protrusion 214 contacts the third guide surface 319B of the second wall 319. This contact causes the holder 210 to further move in the direction from the other side toward the one side in the first direction, so that the displacement in the first direction between the electrical contact surface 202 and the electrical contact 300 is eliminated. As a result, the first protrusion 213 enters the first groove 312 and the second protrusion 214 enters the second groove 313.

Further, there may be an instance where the electrical contact surface 202 is displaced from the predetermined position relative to the electrical contact 300 in the direction from the other side toward the one side in the second direction or in the direction from the one side toward the other side in the second direction.

Figure 15A:
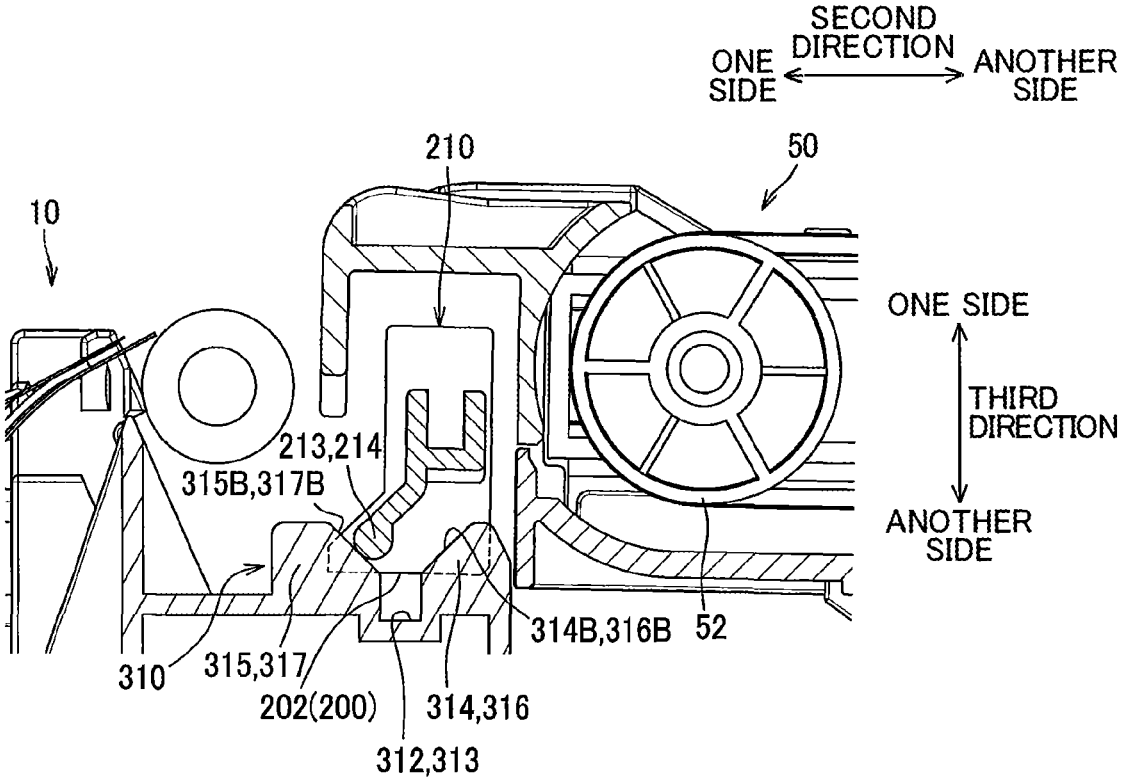
FIG. 15A is a cross-sectional view of the protrusion of the holder and the contact holder taken along a plane perpendicular to the first direction, and particularly illustrating a state where the protrusion is being guided by the first sloped surface.

As illustrated in FIG. 15A, in a case where the electrical contact surface 202 is displaced from the predetermined position in the direction from the other side toward the one side in the second direction, the second guide surface 315B of the fourth guide 315 guides the first protrusion 213 to the first groove 312, and the second guide surface 317B of the sixth guide 317 guides the second protrusion 214 to the second groove 313.

Figure 15B:
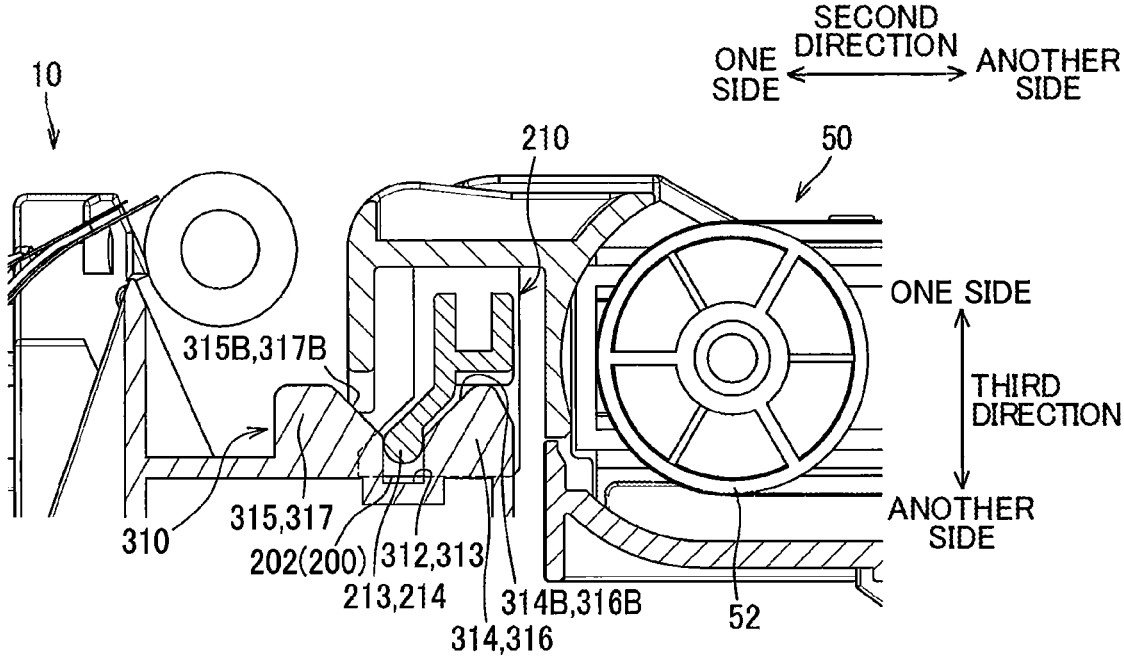
FIG. 15B is a cross-sectional view of the protrusion of the holder and the contact holder taken along the plane perpendicular to the first direction, and particularly illustrating a state where the protrusion has entered a groove of the contact holder.

In a case where the electrical contact surface 202 is displaced from the predetermined position in the direction from the one side toward the other side in the second direction (this case is not illustrated in the drawings), the second guide surface 314B of the third guide 314 guides the first protrusion 213 to the first groove 312, and the second guide surface 316B of the fifth guide 316 guides the second protrusion 214 to the second groove 313. Accordingly, the displacement of the holder 210 in the second direction is eliminated, and the first protrusion 213 enters the first groove 312 and the second protrusion 214 enters the second groove 313 as illustrated in FIG. 15B.

When the first protrusion 213 has entered the first groove 312, the first protrusion 213 is nipped between the third guide 314 and the fourth guide 315, so that the first protrusion 213 becomes unable to move in the second direction.

When the second protrusion 214 has entered the second groove 313, the second protrusion 214 is nipped between the fifth guide 316 and the sixth guide 317, so that the second protrusion 214 becomes unable to move in the second direction. In this way, the position of the holder 210 in the second direction is fixed.

According to the transfer belt unit 50 described above, in a case where the transfer belt unit 50 is attached to the main body 10, the electrical contact surface 202 of the belt memory 200 is movable in the direction crossing the pressing direction. Therefore, the position of the electrical contact surface 202 with respect to the reader (for example, the electrical contact 300) can be stably fixed. As a result, error in reading from the storage element 201 of the belt memory 200 can be restrained.

Further, the holder 210 is movable relative to the belt frame 55 in at least one direction parallel to the electrical contact surface 202. Therefore, even in a case where the electrical contact surface 202 is displaced from the reader in the at least one direction parallel to the electrical contact surface 202, the electrical contact surface 202 can be subjected to positioning in a stable manner.

Further, the holder 210 is movable relative to the belt frame 55 in the first direction which is the axial direction of the drive roller 51. Therefore, even in a case where the electrical contact surface 202 is displaced from the reader in the first direction, the position of the electrical contact surface 202 can be stably fixed.

Further, the pressing member 220 is positioned between the belt frame 55 and the holder 210 to presses the holder 210 in the direction away from the belt frame 55. Therefore, the holder 210 is pressed toward the reader by the pressing member 220. As a result, stabilized contact between the electrical contact surface 202 and the reader is attained.

Further, the holder 210 is movable relative to the belt frame 55 in the second direction crossing the first direction. Therefore, even in a case where the electrical contact surface 202 is displaced from the reader in the second direction, the position of the electrical contact surface 202 can be stably fixed.

Further, the holder 210 is movable relative to the belt frame 55 in the third direction perpendicular to the first and second directions. Therefore, even in a case where the electrical contact surface 202 is displaced from the reader in the third direction, the position of the electrical contact surface 202 can be stably fixed.

Further, the holder 210 includes the protrusion (the first protrusion 213 and the second protrusion 214). Hence, the position of the holder 210 relative to the main body 10 can be fixed by the protrusion entering the groove (the first groove 312 and the second groove 313) of the contact holder 310.

Further, in order for the holder 210 not to be detached from the belt frame 55, the holder 210 includes the first hook 215A and the second hook 216A as retainers configured to be hooked to the belt frame 55. Therefore, detachment of the holder 210 from the belt frame 55 can be suppressed.

Further, the second hook 216A of the holder 210 has the second hook surface K2. The second hook surface K2 is in contact with the third protrusion 233 in a state where the transfer belt unit 50 is not attached to the main body 10. The second hook surface K2 and the third protrusion 233 are inclined so as to approach the other side in the third direction as extending in the direction from the one side toward the other side in the first direction. Therefore, a contacting surface between the second hook surface K2 and the third protrusion 233 is also inclined so as to approach the other side in the third direction as extending in the direction from the one side toward the other side in the first direction. This structure can prevent the holder 210 from rotating in a direction perpendicular to the third direction. As a result, even when the holder 210 is moved in the second direction, rotation of the holder 210 following the movement of the holder 210 can be prevented.

Further, the image forming apparatus 1 described above includes the main body 10, the transfer belt unit 50, and the electrical contact 300 configured to be in electrical contact with the electrical contact surface 202 in the state where the transfer belt unit 50 is attached to the main body 10. The electrical contact surface 202 is movable in the direction crossing the pressing direction in a case where the transfer belt unit 50 is attached to the main body 10. Therefore, the electrical contact surface 202 can be properly subjected to positioning with respect to the electrical contact 300. As a result, error in reading from the storage element 201 of the belt memory 200 can be suppressed.

Further, the contact holder 310 holding the electrical contact 300 has the first sloped surface for guiding the protrusion of the holder 210 to the groove of the contact holder 310. Therefore, the first sloped surface can guide the protrusion of the holder 210 to the groove and thus the holder 210 can be subjected to stable positioning.

Further, the contact holder 310 holding the electrical contact 300 has the second sloped surface for guiding the protrusion of the holder 210 to the first sloped surface. Therefore, the second sloped surface can guide the protrusion of the holder 210 to the first sloped surface. As a result, even in a case where the holder 210 is largely displaced from the contact holder 310, the displacement can be reduced. That is, the holder 210 can be subjected to rough positioning by the second sloped surface.

Further, the main body 10 includes the lever 350 pivotally movable between the first position and the second position. The lever 350 can lock the transfer belt unit 50 at the contacting position in the state where the lever 350 is at the first position, and can separate the electrical contact surface 202 from the electrical contact 300 in the state where the lever 350 is at the second position. Therefore, the lever 350 can not only lock the transfer belt unit 50 at the contacting position but also separate the transfer belt unit 50 from the contacting position.

While the description has been made in detail with reference to the specific embodiment, it would be apparent to those skilled in the art that many modifications and variations may be made thereto.

For example, in the above-described embodiment, the holder 210 is movable relative to the belt frame 55 in the third direction. However, the holder 210 may be immovable in the third direction as long as the holder 210 is movable in a direction crossing the pressing direction.

In the above described embodiment, the transfer belt unit includes the belt electrode electrically connected to the transfer roller. However, the belt electrode may be omitted.

In the above-described embodiment, the upper surface C11 contactable with the lock surface 352A of the lever 350 is the one side surface of the groove formed in the handle C1. However, any other configuration may be available as long as it can contact the lock surface 352A.

In the above-described embodiment, the transfer belt unit includes the drive roller and the single follower roller. However, the transfer belt unit 50 may include the drive roller 51 and two or more follower rollers.

In the above-described embodiment, the pressing member 220 for pressing the holder 210 is a compression spring.

However, other springs such as a leaf spring and a torsion spring may be employed as the pressing member 220 instead of the compression spring. Alternatively, the pressing member 220 may also be an elastic member such as rubber.

In the above-described embodiment, the color laser printer is exemplified as the image forming apparatus. However, the image forming apparatus is not limited to the color laser printer. Other image forming apparatuses such as a copying machine and a multi-function device can also be employed as the image forming apparatus of the present disclosure.

Implementation can be performed with any combination of the components employed in the above-described embodiment and modifications.

What is claimed is:

1. A transfer belt unit comprising:

a belt frame;

a transfer belt;

a storage element storing therein information on the transfer belt;

an electrical contact surface electrically connected to the storage element; and a holder positioned at the belt frame, the holder holding the electrical contact surface, the holder being movable relative to the belt frame.

2. The transfer belt unit according to claim 1, further comprising:

a pressing member pressing the electrical contact surface in a pressing direction.

3. The transfer belt unit according to claim 2, wherein the holder is movable relative to the belt frame in a direction crossing the pressing direction.

4. The transfer belt unit according to claim 3, wherein the holder is movable relative to the belt frame in at least one direction parallel to the electrical contact surface.

5. The transfer belt unit according to claim 3, further comprising:

a drive roller configured to drive the transfer belt, the drive roller being rotatable about a first axis extending in a first direction, the drive roller being in contact with an inner peripheral surface of the transfer belt; and a follower roller configured to rotate about a second axis in accordance with the transfer belt being driven, the second axis extending in the first direction, the follower roller being in contact with the inner peripheral surface of the transfer belt, the follower roller being positioned spaced away from the drive roller in a second direction crossing the first direction, wherein the holder is movable relative to the belt frame in the first direction.

6. The transfer belt unit according to claim 5, wherein the belt frame rotatably supports the drive roller and the follower roller.

7. The transfer belt unit according to claim 5, wherein the pressing member is positioned between the belt frame and the holder, the pressing member pressing the holder in a direction away from the belt frame.

8. The transfer belt unit according to claim 5, wherein the holder is movable relative to the belt frame in the second direction.

9. The transfer belt unit according to claim 5, wherein the holder is positioned closer to the follower roller than to the drive roller in the second direction.

10. The transfer belt unit according to claim 5, further comprising a transfer roller rotatable about a third axis extending in the first direction, the transfer roller being in contact with the inner peripheral surface of the transfer belt.

11. The transfer belt unit according to claim 10, wherein the belt frame rotatably supports the transfer roller.

12. The transfer belt unit according to claim 10, further comprising a belt electrode electrically connected to the transfer roller, the belt frame having one end portion and another end portion in the first direction, the belt electrode being positioned at the another end portion of the belt frame in the first direction, wherein the holder is positioned closer to the one end portion in the first direction of the belt frame than to the another end portion.

13. The transfer belt unit according to claim 5, wherein the holder is movable in a third direction perpendicular to both the first direction and the second direction.

14. The transfer belt unit according to claim 5, wherein the transfer belt unit is attachable to and detachable from a main body of an image forming apparatus, and wherein the holder comprises:

a memory holding portion holding the electrical contact surface; and a protrusion protruding from a body portion of the holder in the first direction, the protrusion being configured to enter a groove of the main body to fix a position of the holder with respect to the main body.

15. The transfer belt unit according to claim 3, wherein the holder further comprises a hook configured to be hooked to the belt frame to prevent the holder from being detached from the belt frame.

16. The transfer belt unit according to claim 3, wherein the transfer belt unit is attachable to and detachable from a main body of an image forming apparatus, wherein the main body comprises a photosensitive drum and a fixing unit, and wherein the transfer belt is in contact with the photosensitive drum in a state where the transfer belt unit is attached to the main body, the transfer belt being configured to:

transfer a toner image formed on the photosensitive drum onto a sheet conveyed to a portion between the photosensitive drum and the transfer belt; and convey, to the fixing unit, the sheet conveyed to the portion between the photosensitive drum and the transfer belt.

17. The transfer belt unit according to claim 3, wherein the storage element stores therein at least one of:

a manufacturing serial number of the transfer belt unit;

an identification code for indicating that the transfer belt unit is a genuine product;

a model and specification of an image forming apparatus compatible with the transfer belt unit;

information for indicating a service life of the transfer belt;

information for indicating whether the transfer belt is a new product;

a cumulative number of rotations of the transfer belt;

a cumulative number of sheets printed using the transfer belt; and an error history of the transfer belt.

18. The transfer belt unit according to claim 3, wherein the transfer belt unit is attachable to and detachable from a main body of an image forming apparatus.

19. An image forming apparatus comprising:

a main body;

the transfer belt unit according to claim 14; and an electrical contact configured to be in electrical contact with the electrical contact surface of the transfer belt unit in a state where the transfer belt unit is attached to the main body.

20. The image forming apparatus according to claim 19, wherein the main body comprises a contact holder holding the electrical contact, the contact holder having a first sloped surface configured to guide the protrusion to the groove, the first sloped surface being inclined relative to the electrical contact surface in the state where the transfer belt unit is attached to the main body.

21. The image forming apparatus according to claim 20, wherein the contact holder has a second sloped surface configured to guide the protrusion to the first sloped surface, the second sloped surface being inclined relative to the electrical contact surface in the state where the transfer belt unit is attached to the main body.

22. The image forming apparatus according to claim 19, wherein the main body comprises a lever pivotally movable between a first position and a second position, wherein, in a state where the lever is at the first position, the lever locks the transfer belt unit at a contacting position to cause the electrical contact surface to be in contact with the electrical contact, and wherein, in a state where the lever is at the second position, the lever separates the electrical contact surface from the electrical contact.

23. The image forming apparatus according to claim 22, wherein the lever is pivotally movable about a lever axis extending in the second direction.

24. The image forming apparatus according to claim 22, wherein the lever comprises:

a pivot shaft extending in the second direction and rotatable about the lever axis;

a first arm extending from an outer peripheral surface of the pivot shaft, the first arm having a lock surface; and a second arm extending from the outer peripheral surface of the pivot shaft in a direction different from an extending direction of the first arm, wherein, in the state where the lever is at the first position, the lock surface is in contact with a part of the transfer belt unit to lock the transfer belt unit at the contacting position, and wherein, in a case where the first arm is pushed, the contact of the lock surface with the part of the transfer belt unit is released and the second arm pushes up the transfer belt unit.

* * * * *